US010347074B2

(12) United States Patent
Hughes et al.

(10) Patent No.: US 10,347,074 B2
(45) **Date of Patent: *Jul. 9, 2019**

(54) GAMING SYSTEM AND METHOD DISPLAYING ONE OR MORE ADDITIONAL SYMBOLS OF A GROUP OF DESIGNATED SYMBOLS WHEN LESS THAN ALL OF THE DESIGNATED SYMBOLS OF THE GROUP ARE DISPLAYED

(71) Applicant: IGT, Las Vegas, NV (US)

(72) Inventors: William K. Hughes, Reno, NV (US); Bradford D. Brown, Sparks, NV (US); Kimberly N. LeFever, Reno, NV (US)

(73) Assignee: IGT, Las Vegas, NV (US)

( * ) Notice: Subject to any disclaimer, the term of this patent is extended or adjusted under 35 U.S.C. 154(b) by 38 days.

This patent is subject to a terminal disclaimer.

(21) Appl. No.: 15/001,917

(22) Filed: Jan. 20, 2016

(65) Prior Publication Data

US 2016/0140797 A1 May 19, 2016

Related U.S. Application Data

(63) Continuation of application No. 13/402,612, filed on Feb. 22, 2012, now Pat. No. 9,251,653.

(51) Int. Cl.
*G07F 17/32* (2006.01)
*G07F 17/34* (2006.01)

(52) U.S. Cl.
CPC ..... *G07F 17/3213* (2013.01); *G07F 17/3244* (2013.01); *G07F 17/3267* (2013.01); *G07F 17/34* (2013.01)

(58) Field of Classification Search
CPC ..... G07F 17/3213; G07F 17/3244
(Continued)

(56) References Cited

U.S. PATENT DOCUMENTS 1,564,746 A 12/1925 Green
3,977,681 A 8/1976 Deitrich
(Continued)

FOREIGN PATENT DOCUMENTS

AU 1987074936 6/1987
GB 2 062 922 5/1981
(Continued)

*Primary Examiner* — Jason Skaarup
(74) *Attorney, Agent, or Firm* — Neal, Gerber & Eisenberg LLP

(57) ABSTRACT

In various embodiments, the gaming system is configured to operate a slot game including a plurality of reels, one of which includes a plurality of designated symbols adjacent to one another on the reel forming a group of designated symbols. For a play of the game, if at least a first quantity of the designated symbols of the group of designated symbols but less than a second greater quantity of the designated symbols of the group of designated symbols is displayed, the gaming system displays one or more other designated symbols of the group of designated symbols in addition to the displayed designated symbols of the group of designated symbols such that the second greater quantity of the designated symbols is displayed. The gaming system determines and provides any awards based on the displayed symbols including any displayed designated symbols of the second greater quantity of the designated symbols.

20 Claims, 14 Drawing Sheets

(58) Field of Classification Search
USPC ..... 463/18, 19, 20, 21
See application file for complete search history.

(56) References Cited

U.S. PATENT DOCUMENTS

| | | | |
|---|---|---|---|
| 4,099,722 | A | 7/1978 | Rodesch et al. |
| 4,114,890 | A | 9/1978 | Yamamoto et al. |
| 4,200,291 | A | 4/1980 | Hooker |
| 4,448,419 | A | 5/1984 | Telnaes |
| 4,573,681 | A | 3/1986 | Okada |
| 4,651,996 | A | 3/1987 | Watkins, Jr. |
| 4,838,552 | A | 6/1989 | Hagiwara |
| RE34,244 | E | 5/1993 | Hagiwara |
| 5,280,909 | A | 1/1994 | Tracy |
| 5,308,065 | A | 5/1994 | Bridgeman et al. |
| 5,332,228 | A | 7/1994 | Schultz |
| 5,342,049 | A | 8/1994 | Wichinsky et al. |
| 5,393,061 | A | 2/1995 | Manship et al. |
| 5,395,111 | A | 3/1995 | Inoue |
| 5,423,539 | A | 6/1995 | Nagao |
| 5,431,408 | A | 7/1995 | Adams |
| 5,449,173 | A | 9/1995 | Thomas et al. |
| 5,560,603 | A | 10/1996 | Seelig et al. |
| 5,580,053 | A | 12/1996 | Crouch |
| 5,584,764 | A | 12/1996 | Inoue |
| 5,609,524 | A | 3/1997 | Inoue |
| 5,611,535 | A | 3/1997 | Tiberio |
| 5,704,835 | A | 1/1998 | Dietz, II |
| 5,720,662 | A | 2/1998 | Holmes, Jr. et al. |
| 5,722,891 | A | 3/1998 | Inoue |
| 5,752,881 | A | 5/1998 | Inoue |
| 5,766,074 | A | 6/1998 | Cannon et al. |
| 5,769,716 | A | 6/1998 | Saffari et al. |
| 5,788,573 | A | 8/1998 | Baerlocher et al. |
| 5,807,172 | A | 9/1998 | Piechowiak |
| 5,816,918 | A | 10/1998 | Kelly et al. |
| 5,823,873 | A | 10/1998 | Moody |
| 5,823,874 | A | 10/1998 | Adams |
| 5,833,238 | A | 11/1998 | Watanabe |
| 5,833,536 | A | 11/1998 | Davids et al. |
| 5,833,537 | A | 11/1998 | Barrie |
| 5,848,932 | A | 12/1998 | Adams |
| 5,863,249 | A | 1/1999 | Inoue |
| 5,882,261 | A | 3/1999 | Adams |
| 5,911,418 | A | 6/1999 | Adams |
| 5,927,714 | A | 7/1999 | Kaplan |
| 5,934,672 | A | 8/1999 | Sines et al. |
| 5,947,820 | A | 9/1999 | Morro et al. |
| 5,951,397 | A | 9/1999 | Dickinson |
| 5,980,384 | A | 11/1999 | Barrie |
| 5,984,782 | A | 11/1999 | Inoue |
| 6,001,016 | A | 12/1999 | Walker et al. |
| 6,024,640 | A | 2/2000 | Walker et al. |
| 6,027,115 | A | 2/2000 | Griswold et al. |
| 6,056,642 | A | 5/2000 | Bennett |
| 6,059,658 | A | 5/2000 | Mangano et al. |
| 6,068,552 | A | 5/2000 | Walker et al. |
| 6,086,066 | A | 7/2000 | Takeuchi et al. |
| 6,089,977 | A | 7/2000 | Bennett |
| 6,089,978 | A | 7/2000 | Adams |
| 6,093,102 | A | 7/2000 | Bennett |
| 6,095,921 | A | 8/2000 | Walker et al. |
| 6,117,013 | A | 9/2000 | Eiba |
| 6,120,031 | A | 9/2000 | Adams |
| 6,149,521 | A | 11/2000 | Sanduski |
| 6,159,095 | A | 12/2000 | Frohm et al. |
| 6,159,098 | A | 12/2000 | Slomiany et al. |
| 6,168,520 | B1 | 1/2001 | Baerlocher et al. |
| 6,174,235 | B1 | 1/2001 | Walker et al. |
| 6,190,254 | B1 | 2/2001 | Bennett |
| 6,220,959 | B1 | 4/2001 | Holmes, Jr. et al. |
| 6,227,971 | B1 | 5/2001 | Weiss |
| 6,241,607 | B1 | 6/2001 | Payne et al. |
| 6,251,013 | B1 | 6/2001 | Bennett |
| 6,299,165 | B1 | 10/2001 | Nagano |
| 6,299,170 | B1 | 10/2001 | Yoseloff |
| 6,302,398 | B1 | 10/2001 | Vecchio |
| 6,309,300 | B1 | 10/2001 | Glavich |
| 6,311,976 | B1 | 11/2001 | Yoseloff et al. |
| 6,319,124 | B1 | 11/2001 | Baerlocher et al. |
| 6,322,078 | B1 | 11/2001 | Adams |
| 6,322,309 | B1 | 11/2001 | Thomas et al. |
| 6,334,814 | B1 | 1/2002 | Adams |
| 6,358,144 | B1 | 3/2002 | Kadlic et al. |
| 6,358,146 | B1 | 3/2002 | Adams |
| 6,364,766 | B1 | 4/2002 | Anderson et al. |
| 6,371,852 | B1 | 4/2002 | Acres |
| 6,375,567 | B1 | 4/2002 | Acres |
| 6,375,569 | B1 | 4/2002 | Acres |
| 6,386,974 | B1 | 5/2002 | Adams |
| 6,398,644 | B1 | 6/2002 | Perrie et al. |
| 6,413,162 | B1 | 7/2002 | Baerlocher et al. |
| 6,416,408 | B2 | 7/2002 | Tracy et al. |
| 6,419,579 | B1 | 7/2002 | Bennett |
| 6,428,412 | B1 | 8/2002 | Anderson et al. |
| 6,439,993 | B1 | 8/2002 | O'Halloran |
| 6,439,995 | B1 | 8/2002 | Hughs-Baird et al. |
| 6,464,581 | B1 | 10/2002 | Yoseloff et al. |
| 6,506,114 | B1 | 1/2003 | Estes et al. |
| 6,514,141 | B1 | 2/2003 | Kaminkow et al. |
| 6,517,432 | B1 | 2/2003 | Jaffe |
| 6,517,433 | B2 | 2/2003 | Loose et al. |
| 6,551,187 | B1 | 4/2003 | Jaffe |
| 6,561,900 | B1 | 5/2003 | Baerlocher et al. |
| 6,561,904 | B2 | 5/2003 | Locke et al. |
| 6,565,433 | B1 | 5/2003 | Baerlocher et al. |
| 6,585,591 | B1 | 7/2003 | Baerlocher et al. |
| 6,604,740 | B1 | 8/2003 | Singer et al. |
| 6,605,000 | B2 | 8/2003 | Adams |
| 6,616,142 | B2 | 9/2003 | Adams |
| 6,634,945 | B2 | 10/2003 | Glavich et al. |
| 6,644,663 | B2 | 11/2003 | Seelig et al. |
| 6,663,488 | B1 | 12/2003 | Adams |
| 6,663,489 | B2 | 12/2003 | Baerlocher |
| 6,676,511 | B2 | 1/2004 | Payne et al. |
| 6,719,630 | B1 | 4/2004 | Seelig et al. |
| 6,722,976 | B2 | 4/2004 | Adams |
| 6,726,204 | B2 | 4/2004 | Inoue |
| 6,731,313 | B1 | 5/2004 | Kaminkow |
| 6,769,986 | B2 | 8/2004 | Vancura |
| 6,780,109 | B2 | 8/2004 | Kaminkow |
| 6,793,577 | B1 | 9/2004 | Wilkins et al. |
| 6,805,349 | B2 | 10/2004 | Baerlocher et al. |
| 6,827,646 | B2 | 12/2004 | Adams |
| 6,835,133 | B2 | 12/2004 | Baerlocher et al. |
| 6,855,054 | B2 | 2/2005 | White et al. |
| 6,857,958 | B2 | 2/2005 | Osawa |
| 6,866,583 | B2 * | 3/2005 | Glavich ..... G07F 17/34 273/138.2 |
| D503,951 | S | 4/2005 | Karstens |
| 6,880,826 | B2 | 4/2005 | Inoue |
| 6,905,406 | B2 | 6/2005 | Kaminkow et al. |
| 6,918,832 | B2 | 7/2005 | Baerlocher et al. |
| 6,921,335 | B2 | 7/2005 | Rodgers et al. |
| 6,923,441 | B2 | 8/2005 | Inoue |
| 6,932,700 | B2 | 8/2005 | Bennett et al. |
| 6,942,572 | B2 | 9/2005 | Inoue |
| 6,960,133 | B1 | 11/2005 | Marks et al. |
| 6,964,609 | B2 | 11/2005 | Haag et al. |
| 6,976,915 | B2 | 12/2005 | Baker et al. |
| 6,981,635 | B1 | 1/2006 | Hughs-Baird et al. |
| 6,988,947 | B2 | 1/2006 | Baerlocher et al. |
| 6,997,808 | B2 | 2/2006 | Rodgers et al. |
| 7,001,274 | B2 | 2/2006 | Baerlocher et al. |
| 7,004,835 | B2 | 2/2006 | Baerlocher |
| 7,014,560 | B2 | 3/2006 | Glavich et al. |
| 7,048,275 | B2 | 5/2006 | Adams |
| 7,056,213 | B2 | 6/2006 | Ching et al. |
| 7,066,814 | B2 | 6/2006 | Glavich et al. |
| 7,070,502 | B1 | 7/2006 | Bussick et al. |
| 7,074,127 | B2 | 7/2006 | Cuddy et al. |
| 7,077,744 | B2 | 7/2006 | Cannon |
| 7,077,745 | B2 | 7/2006 | Gomez et al. |
| 7,090,580 | B2 | 8/2006 | Rodgers et al. |

(56) References Cited

U.S. PATENT DOCUMENTS 7,094,148 B2 8/2006 Baerlocher et al.
7,137,888 B2 11/2006 Glavich et al.
7,144,322 B2 12/2006 Gomez et al.
7,160,187 B2 1/2007 Loose et al.
7,168,704 B1 1/2007 Lawless
7,169,042 B2 1/2007 Muir et al.
7,204,753 B2 4/2007 Ozaki et al.
7,226,359 B2 6/2007 Bussick et al.
7,252,591 B2 8/2007 Van Asdale
7,252,592 B2 8/2007 Rodgers et al.
7,275,988 B2 10/2007 Aida et al.
7,311,607 B2 12/2007 Tedsen et al.
7,331,862 B2 2/2008 Rodgers et al.
7,331,866 B2 2/2008 Rodgers et al.
7,396,279 B2 7/2008 Berman et al.
7,399,225 B2 7/2008 Kaminkow
7,402,102 B2 7/2008 Marks et al.
7,442,123 B2 10/2008 Brill et al.
7,448,948 B2 11/2008 Hughs-Baird et al.
7,494,413 B2 2/2009 Singer et al.
7,513,826 B2 4/2009 Cuddy
7,526,736 B2 4/2009 Kaminkow et al.
7,553,231 B2 6/2009 Rodgers et al.
7,591,723 B2 9/2009 Cregan et al.
7,607,980 B2 10/2009 Masci et al.
7,611,406 B2 11/2009 Fuller
7,674,174 B2 3/2010 Marks et al.
7,690,986 B2 4/2010 Ching et al.
7,699,696 B2 4/2010 Baerlocher et al.
7,699,698 B2 4/2010 Randall
7,749,063 B2 7/2010 Belger et al.
7,753,773 B2 7/2010 Baerlocher et al.
7,771,267 B2 8/2010 Mayeroff
7,775,874 B2 8/2010 Ching et al.
7,789,751 B2 9/2010 Glavich et al.
7,819,740 B2 10/2010 Masci et al.
7,850,521 B2 12/2010 Rodgers et al.
7,857,695 B2 12/2010 Rodgers et al.
7,892,081 B2 2/2011 Glavich et al.
7,950,994 B2 5/2011 Berman et al.
8,002,625 B2 8/2011 Maya
8,007,357 B2 8/2011 Cuddy
2001/0003709 A1 6/2001 Adams
2002/0045474 A1* 4/2002 Singer ..... G07F 17/32 463/20
2002/0052234 A1 5/2002 Adams
2002/0068623 A1 6/2002 Gauselmann
2002/0077165 A1 6/2002 Bansemer et al.
2002/0142826 A1 10/2002 Adams
2002/0142830 A1 10/2002 Adams
2002/0198038 A1 12/2002 Adams
2003/0013520 A1 1/2003 Adams
2003/0036422 A1 2/2003 Baerlocher et al.
2003/0054874 A1 3/2003 Kaminkow
2003/0057645 A1 3/2003 Baerlocher et al.
2003/0060267 A1 3/2003 Glavich et al.
2003/0060272 A1 3/2003 Glavich et al.
2003/0087689 A1 5/2003 Adams
2003/0100356 A1 5/2003 Brown et al.
2003/0114216 A1 6/2003 Adams
2003/0125100 A1 7/2003 Cannon
2003/0203752 A1 10/2003 Kaminkow et al.
2003/0203753 A1 10/2003 Muir et al.
2004/0002372 A1 1/2004 Rodgers et al.
2004/0033829 A1 2/2004 Pacey et al.
2004/0038728 A1 2/2004 Adams
2004/0038734 A1 2/2004 Adams
2004/0048645 A1 3/2004 Webb et al.
2004/0048650 A1 3/2004 Mierau et al.
2004/0051240 A1 3/2004 Adams
2004/0053660 A1 3/2004 Webb et al.
2004/0053665 A1 3/2004 Baerlocher
2004/0053676 A1 3/2004 Rodgers
2004/0077403 A1 4/2004 Maya et al.
2004/0102244 A1* 5/2004 Kryuchkov ..... G07F 17/32 463/32
2004/0242313 A1 12/2004 Munoz
2004/0248640 A1 12/2004 Kaminkow et al.
2005/0026678 A1 2/2005 Kaminkow
2005/0049035 A1 3/2005 Baerlocher et al.
2005/0054405 A1 3/2005 Baerlocher et al.
2005/0054418 A1 3/2005 Baerlocher
2005/0059477 A1 3/2005 Baerlocher
2005/0059478 A1 3/2005 Peterson et al.
2005/0059486 A1 3/2005 Kaminkow
2005/0064924 A1 3/2005 Glavich et al.
2005/0075159 A1 4/2005 Kaminkow et al.
2005/0148384 A1 7/2005 Marks et al.
2005/0159211 A1 7/2005 Englman
2005/0192081 A1 9/2005 Marks et al.
2005/0227754 A1 10/2005 Kaminkow et al.
2005/0282620 A1 12/2005 Marks et al.
2005/0288094 A1 12/2005 Marks et al.
2006/0019738 A1 1/2006 Baerlocher et al.
2006/0030392 A1 2/2006 Rodgers et al.
2006/0040728 A1 2/2006 Fuller
2006/0046830 A1 3/2006 Webb
2006/0068875 A1 3/2006 Cregan et al.
2006/0068884 A1 3/2006 Baerlocher et al.
2006/0073872 A1 4/2006 B-Jensen et al.
2006/0073879 A1 4/2006 Baerlocher
2006/0084492 A1 4/2006 Baerlocher et al.
2006/0084498 A1 4/2006 Baerlocher et al.
2006/0089191 A1 4/2006 Singer et al.
2006/0111174 A1 5/2006 Baerlocher et al.
2006/0116195 A1 6/2006 Baerlocher et al.
2006/0135247 A1 6/2006 Baerlocher et al.
2006/0172795 A1 8/2006 Bussick et al.
2006/0199636 A1 9/2006 Ching et al.
2006/0199637 A1 9/2006 Ching et al.
2007/0004489 A1 1/2007 Rodgers et al.
2007/0021175 A1 1/2007 Rodgers et al.
2007/0021188 A1 1/2007 Rodgers et al.
2007/0060246 A1 3/2007 Baerlocher et al.
2007/0060248 A1 3/2007 Rodgers et al.
2007/0060294 A1 3/2007 Cuddy et al.
2007/0087812 A1 4/2007 Glavich et al.
2008/0045309 A1 2/2008 Okada
2008/0090643 A1 4/2008 Kaminkow et al.
2008/0108409 A1 5/2008 Cole et al.
2008/0108411 A1 5/2008 Jensen et al.
2008/0139298 A1 6/2008 Rodgers et al.
2008/0182650 A1 7/2008 Randall et al.
2008/0268941 A1 10/2008 Kaminkow
2008/0280673 A1 11/2008 Marks et al.
2009/0061984 A1 3/2009 Yi
2009/0111577 A1 4/2009 Mead
2009/0118004 A1 5/2009 Hoffman
2009/0124342 A1 5/2009 Fong
2009/0124347 A1 5/2009 Rodgers et al.
2009/0170592 A1 7/2009 Cuddy
2009/0227337 A1 9/2009 Langille et al.
2010/0004050 A1 1/2010 Caputo et al.
2010/0022297 A1 1/2010 Saunders
2010/0029364 A1 2/2010 Zielinski
2010/0120501 A1 5/2010 Hoffman et al.
2010/0120504 A1 5/2010 Larsen
2010/0124972 A1 5/2010 Rodgers et al.
2011/0111826 A1 5/2011 Baerlocher et al.
2011/0130193 A1 6/2011 Belger et al.
2011/0190044 A1 8/2011 Berman et al.
2013/0143635 A1 6/2013 Arora et al.

FOREIGN PATENT DOCUMENTS

GB 2 097 160 10/1982
GB 2 106 293 4/1983
GB 2 106 295 4/1983
GB 2 165 385 4/1986
GB 2 372 132 8/2002
GB 2 372 617 8/2002

(56) References Cited

FOREIGN PATENT DOCUMENTS

| | | |
|---|---|---|
| WO | WO 1998/020949 | 5/1998 |
| WO | WO 2000/030727 | 6/2000 |
| WO | WO 2007/053349 | 5/2007 |

* cited by examiner

GAMING SYSTEM AND METHOD DISPLAYING ONE OR MORE ADDITIONAL SYMBOLS OF A GROUP OF DESIGNATED SYMBOLS WHEN LESS THAN ALL OF THE DESIGNATED SYMBOLS OF THE GROUP ARE DISPLAYED

PRIORITY CLAIM

This application is a continuation of, and claims priority to and the benefit of, U.S. patent application Ser. No. 13/402,612, which was filed on Feb. 22, 2012, the entire contents of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines that provide players awards in primary or base games are well known. These gaming machines generally require a player to place a wager to activate a play of the primary game. For many of these gaming machines, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming machines, an amount of a wager placed on a primary game by a player may vary. For instance, a gaming machine may enable the player to wager a minimum number of credits, such as one credit (e.g., one cent, nickel, dime, quarter, or dollar), up to a maximum quantity of credits, such as five credits. The gaming machine may enable the player to place this wager a single time or multiple times for a single play of the primary game. For instance, a gaming machine configured to operate a slot game may have one or more paylines, and the gaming machine may enable a player to place a wager on each if the paylines for a single play of the slot game. Thus, it is known that a gaming machine, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Various slot games include a plurality of reels, at least one of which includes a plurality of wild symbols positioned adjacent to one another on the reel to form a stack of wild symbols on the reel. During a play of one of these slot games, the reels are spun and one or more of the wild symbols of the stack of wild symbols may be generated and displayed as a result of the spin of the reels. That is, following a spin of the reels: (a) at least one, but less than all, of the wild symbols of the stack of wild symbols may be generated and displayed; (b) all of the wild symbols of the stack of wild symbols may be generated and displayed; or (c) none of the wild symbols of the stack of wild symbols may be generated and displayed. The fact that a portion, but less than all, of the stack of wild symbols may be generated and displayed following a spin of the reels may frustrate and detract from the gaming experience of certain players, especially those who enjoy large amounts of action and a high hit frequency while playing slot games. Accordingly, there is a continuing need to provide wagering games including new and exciting ways of providing players with entire symbol stacks during game play.

SUMMARY

The present disclosure provides various embodiments of a gaming system and method displaying one or more additional symbols of a group of designated symbols, such as a symbol stack, when less than all of the symbols of the group of designated symbols are displayed. In general, following a spin of the reels of a slot game, if a portion, but less than all, of a group of designated symbols is displayed, the gaming system displays one or more other designated symbols of the group of designated symbols such that a greater quantity of the designated symbols of the group of designated symbols is displayed.

More specifically, in various embodiments, the gaming system is configured to operate a spinning reel type game including a plurality of video reels. Each of the reels includes a plurality of symbols and is associated with a plurality of symbol display areas. The symbols of at least one of the reels include a plurality of designated symbols adjacent to one another on the reel forming a stack of designated symbols. For a play of the game, following a spin of the reels, if at least a first quantity of the designated symbols of the stack of designated symbols but less than a second greater quantity of the designated symbols of the stack of designated symbols is displayed, the gaming system displays one or more other designated symbols of the stack of designated symbols at the symbol display areas at which the designated symbols of the stack of designated symbols are already displayed such that the second greater quantity of the designated symbols is displayed. The gaming system displays the one or more other designated symbols at the symbol display areas at which the designated symbols of the stack of designated symbols are already displayed in addition to the displayed designated symbols of the stack of designated symbols such that a plurality of the designated symbols are displayed in a same one of the symbol display areas. The gaming system determines any awards based on the displayed symbols including any displayed designated symbols of the second greater quantity of the designated symbols, and provides any determined awards.

In one example, a first one of the reels includes a stack of three WILD symbols. In this example, the first quantity is equal to one and the second greater quantity is equal to three, which is the total quantity of WILD symbols of the stack of three WILD symbols. In this example, when only one of the WILD symbols of the stack of WILD symbols is displayed at a first symbol display area associated with the first one of the reels, the gaming system additionally displays the remaining two WILD symbols of the stack of WILD symbols at the first symbol display area. Further, when only two of the WILD symbols are displayed at a first and a second symbol display area, respectively, associated with the first one of the reels, the gaming system additionally displays the remaining one WILD symbol of the stack of WILD symbols at one of the first symbol display area and the second symbol display area.

It should thus be appreciated that, in various embodiments, the present disclosure provides gaming systems configured to operate new and exciting games that provide players with an entire symbol stack during game play when only a portion of that symbol stack is displayed, thereby increasing player enjoyment and excitement and improving overall gaming experience.

Additional features and advantages are described herein, and will be apparent from, the following Detailed Description and the Figures.

DETAILED DESCRIPTION

Figure 1:
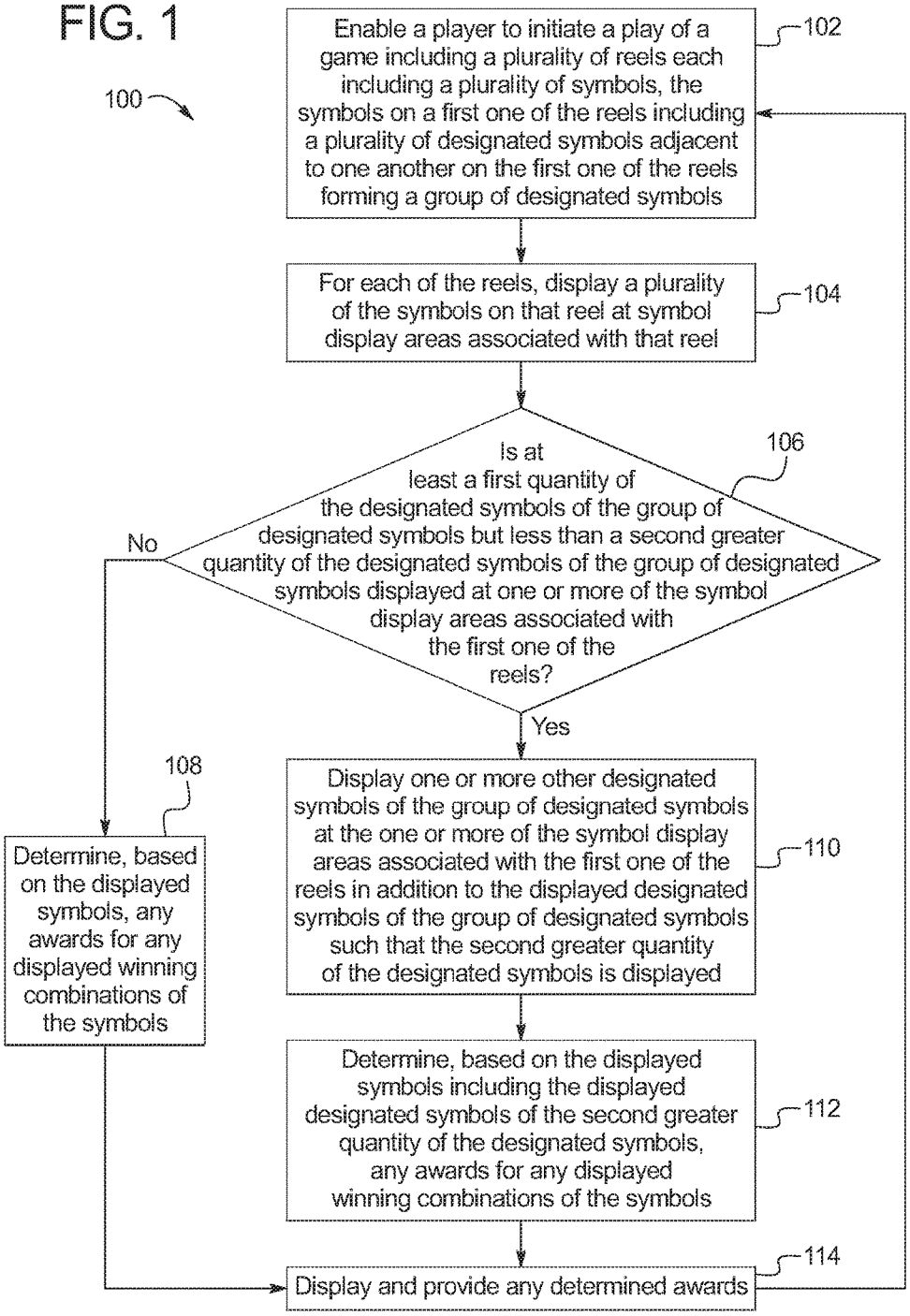
FIG. 1 is a flowchart illustrating an example method of operating an embodiment of the gaming system of the present disclosure.

Displaying One or More Additional Symbols of a Group of Designated Symbols when Less than all of the Designated Symbols of the Group are Displayed The present disclosure provides various embodiments of a gaming system and method displaying one or more additional symbols of a group of designated symbols when less than all of the symbols of the group of designated symbols are displayed. Unless otherwise noted, it should be appreciated that the embodiments and examples described below include one or more groups of designated symbols in the form of a stack or stacks of designated symbols (also referred to as a symbol stack or stacks). In general, the gaming system is configured to operate a spinning reel type game including a plurality of video reels, one of which includes a plurality of designated symbols adjacent to one another on the reel forming a stack of designated symbols. For a play of the game, following a spin of the reels, if at least a first quantity of the designated symbols of the stack of designated symbols but less than a second greater quantity of the designated symbols of the stack of designated symbols is displayed, the gaming system displays one or more other designated symbols of the stack of designated symbols in addition to the displayed designated symbols of the stack of designated symbols such that the second greater quantity of the designated symbols is displayed. The gaming system determines any awards based on the displayed symbols including any displayed designated symbols of the second greater quantity of the designated symbols, and provides any determined awards.

The gaming system is configured to operate a spinning reel type, video slot type, or other suitable reel type primary wagering game. The primary wagering game includes a plurality of reels, each of which includes a plurality of symbols. Each of the reels is associated with one or more symbol display areas. For each of one or more of the reels, the symbols on that reel include a plurality of designated symbols adjacent to one another on that reel forming a stack of designated symbols. In various embodiments, the designated symbols are: (a) wild symbols, (b) bonus trigger symbols, and/or (c) "standard" slot game symbols, though it should be appreciated that the designated symbols may be any of the symbols on the reels. In certain embodiments: (a) only one of the reels includes a stack of designated symbols; (b) a plurality, but less than all, of the reels each include a stack of designated symbols; (c) all of the reels each include a stack of designated symbols; and/or (d) one or more of the reels each include a stack of designated symbols following the occurrence of a suitable triggering event or events. It should be appreciated that, for a given stack of designated symbols, that stack of designated symbols may include any suitable total quantity of designated symbols. For example, a stack of designated symbols on a reel may include a total quantity of designated symbols that is: (a) equal to a total quantity of symbol display areas associated with the reel, (b) less than the total quantity of symbol display areas associated with the reel, or (c) greater than a total quantity of symbol display areas associated with the reel. In certain embodiments, the designated symbols of a stack of designated symbols are not separated by any blanks or blank symbols. In another embodiment, the designated symbols of a stack of designated symbols are separated by one or more blanks or blank symbols.

In certain embodiments, at least one of the reels includes a plurality of stacks of designated symbols. In one such embodiment, at least one of the reels includes a first stack of a plurality of first designated symbols and a second different stack of a plurality of the first designated symbols. For example, one of the reels includes a first stack of three WILD symbols adjacent to one another on the reel and a second different stack of five WILD symbols adjacent to one another on the reel. In another such embodiment, at least one of the reels includes a first stack of a plurality of first designated symbols and a second different stack of a plurality of second different designated symbols. For instance, one of the reels includes a first stack of three WILD symbols adjacent to one another on the reel and a second stack of three BONUS symbols adjacent to one another on the reel.

In operation, in various embodiments, the gaming system enables a player to place a wager for a play of the primary wagering game (as discussed below). For each of the reels, the gaming system causes that reel to spin and display one or more of the symbols on that reel at the symbol display areas associated with that reel. For at least one of the reels including a stack of designated symbols, the gaming system determines whether at least a first quantity of the designated symbols of the stack of designated symbols but less than a second greater quantity of the designated symbols of the stack of designated symbols is displayed at one or more of the symbol display areas associated with that reel. In certain embodiments, the first quantity of the designated symbols is one, and the second greater quantity of the symbols is equal to the total quantity of the designated symbols of the stack of designated symbols. For example, one of the reels includes a stack of three WILD symbols adjacent to one another on the reel. In this example, following a spin of the reel for a play of the primary wagering game, the gaming system determines whether one or two of the WILD symbols of the stack of WILD symbols were displayed (i.e., in this example, whether at least one but less than the total quantity (three) of the WILD symbols of the stack of WILD symbols were displayed). It should be appreciated, however, that the first quantity may be any suitable quantity that is greater than zero and less than the second greater quantity, and that the second greater quantity may be any suitable quantity greater than the first quantity.

If the gaming system determines that either: (a) less than the first quantity of the designated symbols of the stack of designated symbols on that reel is displayed, or (b) at least the second greater quantity of the designated symbols of the stack of designated symbols on that reel is displayed, the gaming system determines, based on the displayed symbols, any awards for any displayed winning combinations of the symbols. The gaming system provides any determined awards. Continuing with the above example, if the gaming system determines that zero or three of the WILD symbols of the stack of three WILD symbols were displayed, the gaming system determines any awards based on the displayed symbols and provides any determined awards.

On the other hand, if the gaming system determines that at least the first quantity of the designated symbols of the stack of designated symbols on that reel but less than the second greater quantity of the designated symbols of the stack of designated symbols on that reel is displayed, the gaming system displays, in addition to the displayed designated symbols of the stack of designated symbols, one or more other designated symbols of the stack of designated symbols such that the second greater quantity of the designated symbols is displayed. In various embodiments in which the first quantity of the designated symbols is equal to one and the second greater quantity of the designated symbols is equal to the total quantity of the designated symbols in the stack of designated symbols, if at least one, but less than all, of the designated symbols of a stack of designated symbols is displayed, the gaming system displays, in addition to the displayed at least one designated symbol of the stack of designated symbols, one or more of the designated symbols of the stack of designated symbols that were not initially displayed following the spin of the reels. Continuing with the above example, if the gaming system determines that one of the WILD symbols of the stack of three WILD symbols was displayed, the gaming system displays, in addition to the displayed one of the WILD symbols, each of the WILD symbols (or one of the WILD symbols, in certain embodiments) of the stack of WILD symbols that were not initially displayed following the spin of the reels (i.e., in this example, the two remaining WILD symbols of the stack of three WILD symbols).

In certain embodiments, the one or more other designated symbols of the stack of designated symbols includes all of the designated symbols of the stack of designated symbols that were not initially displayed following the spin of the reels. In other words, in these embodiments, the second greater quantity of the designated symbols of the stack of designated symbols is equal to the total quantity of the designated symbols in the stack of designated symbols. For example, a stack of WILD symbols on a reel includes a first WILD symbol, a second WILD symbol, and a third WILD symbol. Following a spin of the reels, the first WILD symbol is displayed and the second WILD symbol and the third WILD symbol are not displayed. In this example, the gaming system displays the second WILD symbol and the third WILD symbol in addition to the first WILD symbol. In other embodiments, the one or more other designated symbols of the stack of designated symbols includes at least one, but less than all, of the designated symbols of the stack of designated symbols that were not initially displayed following the spin of the reels. In other words, in these embodiments, the second greater quantity of the designated symbols of the stack of designated symbols is less than the total quantity of the designated symbols in the stack of designated symbols. For example, a stack of WILD symbols on a reel includes a first WILD symbol, a second WILD symbol, and a third WILD symbol. Following a spin of the reels, the first WILD symbol is displayed and the second WILD symbol and the third WILD symbol are not displayed. In this example, the gaming system displays the second WILD symbol or the third WILD symbol, but not both, in addition to the first WILD symbol.

In various embodiments, the gaming system displays the one or more other designated symbols of the stack of designated symbols at one or more of the symbol display areas at which the designated symbols of the stack of designated symbols are displayed such that a plurality of the designated symbols are displayed at at least one of those symbol display areas. In one such embodiment, the gaming system randomly determines at which of the symbol display areas to display each of the one or more other designated symbols of the stack of designated symbols. More specifically, in this embodiment, for each of the one or more other designated symbols of the stack of designated symbols, the gaming system: (a) randomly selects one of the symbol display areas at which one of the designated symbols of the stack of designated symbols is displayed, and (b) displays that other designated symbol at the selected symbol display area in addition to the designated symbol of the stack of designated symbols that is already displayed at the selected symbol display area. For example, a stack of WILD symbols on a reel includes a first WILD symbol, a second WILD symbol, a third WILD symbol, and a fourth WILD symbol. Following a spin of the reels, the first WILD symbol is displayed at a first symbol display area, the second WILD symbol is displayed at a second symbol display area, and the third WILD symbol and the fourth WILD symbol are not displayed. In this example, for each of the third WILD symbol and the fourth WILD symbol, the gaming system: (a) randomly selects one of the first symbol display area and the second symbol display area, and (b) displays that WILD symbol at the selected symbol display area in addition to the WILD symbol already displayed at the selected symbol display area.

In another such embodiment, the gaming system determines at which of the symbol display areas to display each of the one or more other designated symbols of the stack of designated symbols such that the player receives an optimal benefit (such as an optimal award or bonus game). That is, in this embodiment, for each of the one or more other designated symbols of the stack of designated symbols, the gaming system: (a) determines, for each of the symbol display areas at which one of the designated symbols of the stack of designated symbols is displayed, any benefit to the player that would be provided if that other designated symbol was displayed at that symbol display area; and (b) displays that other designated symbol (in addition to the designated symbol of the stack of designated symbols) at the symbol display area associated with the greatest benefit. For example, a stack of WILD symbols on a reel includes a first WILD symbol, a second WILD symbol, and a third WILD symbol. Following a spin of the reels, the first WILD symbol is displayed at a first symbol display area, the second WILD symbol is displayed at a second symbol display area, and the third WILD symbol is not displayed. In this example, the gaming system determines that: (a) if the third WILD symbol was displayed at the first symbol display area, the player would be provided with an award of 1,000 credits associated with the third WILD symbol; and (b) if the third WILD symbol was displayed at the second symbol display area, the player would not be provided with an award associated with the third WILD symbol. Accordingly, the gaming system displays the third WILD symbol in addition to the first WILD symbol at the first symbol display area such that the player wins the award of 1,000 credits associated with the third WILD symbol.

In another such embodiment, at which of the symbol display areas the gaming system displays each of the one or more other designated symbols of the stack of designated symbols is predetermined. For example, a stack of WILD symbols on a reel includes a first WILD symbol, a second WILD symbol, and a third WILD symbol. Following a spin of the reels, the first WILD symbol is displayed at a first symbol display area and the second WILD symbol and the third WILD symbol is not displayed. In this example, it is predetermined that, if only one of the first WILD symbol, the second WILD symbol, and the third WILD symbol is displayed following a spin of the reel, the gaming system displays the remaining two WILD symbols at the symbol display area at which the displayed WILD symbol of the stack of WILD symbols is displayed (in addition to the displayed WILD symbol).

In another such embodiment, the gaming system enables the player to select the symbol display areas at which each of the one or more other designated symbols of the stack of designated symbols are displayed. More specifically, in this embodiment, for each of the one or more other designated symbols of the stack of the designated symbols, the gaming system: (a) enables the player to select one of the symbol display areas at which one of the designated symbols of the stack of designated symbols is displayed, and (b) displays that other designated symbol at the selected symbol display area in addition to the designated symbol of the stack of designated symbols displayed at the selected symbol display area. For example, a stack of WILD symbols on a reel includes a first WILD symbol, a second WILD symbol, a third WILD symbol, and a fourth WILD symbol. Following a spin of the reels, the first WILD symbol is displayed at a first symbol display area, the second WILD symbol is displayed at a second symbol display area, and the third WILD symbol and the fourth WILD symbol are not displayed. In this example, the gaming system enables the player to select: (a) whether to display the third WILD symbol at the first symbol display area in addition to the first WILD symbol or at the second symbol display area in addition to the second WILD symbol, and (b) whether to display the fourth WILD symbol at the first symbol display area in addition to the first WILD symbol or at the second symbol display area in addition to the second WILD symbol. The gaming system displays the third WILD symbol and the fourth WILD symbol in accordance with the player's selections.

In another such embodiment, the gaming system displays, in addition to the displayed designated symbols of the stack of designated symbols, each of the one or more other designated symbols of the stack of the designated symbols at each of the symbol display areas at which one of the designated symbols of the stack of designated symbols is displayed. For example, a stack of WILD symbols on a reel includes a first WILD symbol, a second WILD symbol, a third WILD symbol, and a fourth WILD symbol. Following a spin of the reels, the first WILD symbol is displayed at a first symbol display area, the second WILD symbol is displayed at a second symbol display area, and the third WILD symbol and the fourth WILD symbol are not displayed. In this example, the gaming system displays: (a) the third WILD symbol and the fourth WILD symbol at the first symbol display area in addition to the first WILD symbol, and (b) the third WILD symbol and the fourth WILD symbol at the second symbol display area in addition to the second WILD symbol.

In various embodiments, the gaming system displays the plurality of designated symbols of the stack of designated symbols at a same symbol display area by displaying those designated symbols in a vertical arrangement and not in a horizontal arrangement. For example, the gaming system displays, at a single symbol display area, a first designated symbol above a second designated symbol and a third designated symbol below the second designated symbol. It should be appreciated, however, that such designated symbols may be displayed in any suitable manner in other embodiments.

After the gaming system displays the one or more other designated symbols of the stack of designated symbols, the gaming system determines, based on the displayed symbols (including the displayed symbols of the second greater quantity of the designated symbols of the stack of designated symbols), any awards for any displayed winning combinations of the symbols. The gaming system provides any determined awards.

In certain embodiments, when more than one of the designated symbols of the stack of designated symbols are displayed at one of the symbol display areas, the gaming system makes separate award determinations for each of the designated symbols of the stack of designated symbols displayed at that symbol display area. For example, if a first WILD symbol and a second WILD symbol are both displayed at a first symbol display area along two different paylines, the gaming system makes: (a) award determinations associated with each of the paylines for the first WILD symbol, and (b) separate award determinations associated with each of the paylines for the second WILD symbol. That is, in this example, the award determinations each employ a single one of the WILD symbols, not both WILD symbols at once. In certain of these embodiments, the gaming system does not make an award determination associated with a plurality of such designated symbols displayed at a same symbol display area. Continuing with the above example, the gaming system does not make a single award determination associated with both the first WILD symbol and the second WILD symbol, collectively, along each of the two paylines.

In other embodiments, when more than one of the designated symbols of the stack of designated symbols are displayed at one of the symbol display areas, the gaming system: (a) associates a multiplier with that symbol display area such that any award associated with that symbol display area is multiplied by the multiplier, (b) makes an award determination as if only one of the designated symbols of the stack of the designated symbols was displayed at that symbol display area, and (c) applies the multiplier to any determined awards. In one such embodiment, a value of the multiplier is equal to the total quantity of the designated symbols of the stack of designated symbols displayed at that symbol display area. For example, if a first WILD symbol and a second WILD symbol are both displayed at a first symbol display area along two different paylines, the gaming system: (a) associates a 2× multiplier with the first symbol display area, (b) makes award determinations associated with each of the paylines as if a single WILD symbol was displayed at the first symbol display area, and (c) multiplies any determined awards by the 2× multiplier.

In further embodiments, one or more of the winning symbol combinations take into account the fact that a plurality of designated symbols of the stack of designated symbols may be displayed at a single symbol display area. That is, one or more of the winning symbol combinations include "symbols" comprising multiple designated symbols of the stack of designated symbols.

In various embodiments, the gaming system includes a plurality of bonus or secondary games (as described below). In one such embodiment, a first one of the bonus games is initiated upon the occurrence of a first triggering event, and a second one of the bonus games is initiated upon the occurrence of a second different triggering event. In this embodiment, the first triggering event occurs when at least one of the symbol display areas associated with a reel displays a plurality of bonus trigger symbols (i.e., designated symbols) of a stack of bonus trigger symbols on the reel. The second triggering event occurs when each of the symbol display areas associated with the reel displays only one of the bonus trigger symbols of the stack of bonus trigger symbols on the reel. It should thus be appreciated that, in these embodiments, different bonuses are triggered based on one or more of: (a) how many symbol display areas associated with a reel display designated symbols of a stack of designated symbols on the reel, and (b) how many designated symbols of the stack of designated symbols on the reel are displayed at each of the symbol display areas associated with the reel.

It should be appreciated that the designated symbols of the stacks of designated symbols may be displayed in any suitable manner when a plurality of the designated symbols of the stacks of designated symbols are displayed in a single symbol display area. In one example in which a stack of designated symbols forms a resultant cohesive image (such as four vertically-stacked symbols forming a single image of a Saguaro cactus), the gaming system shrinks the entire resultant cohesive image to fit the requisite symbol display areas. For instance, if only one of the symbol display areas displays one of the four symbols forming the Saguaro cactus, the gaming system shrinks the complete Saguro cactus (including all four symbols) and displays that shrunken image in the single symbol display area. In another example in which a stack of designated symbols includes a plurality of distinct designated symbols (such as four vertically-stacked, distinct WILD symbols), the gaming system shrinks each of the designated symbols such that they fit with one another in the requisite symbol display areas. For instance, if only one of the symbol display areas displays one of the four WILD symbols, the gaming system shrinks each of the four WILD symbols and displays each of the four shrunken WILD symbols at that symbol display area.

While the above embodiments and examples employ a group of designated symbols as a stack of designated symbols positioned adjacent to one another on a single reel, it should be appreciated that the present disclosure contemplates a group of designated symbols spanning multiple reels such as independent reels. In one such embodiment, the group of designated symbols is a designated quantity of designated symbols generated and displayed at the symbol display positions in one of a plurality of predetermined orders (such as horizontally, vertically, diagonally, or in any other suitable order or pattern). In these embodiments, the display of additional symbols of the group of designated symbols proceeds as described above. In one example, the group of designated symbols includes three WILD symbols positioned at horizontally adjacent symbol display areas of a 3×3 matrix of symbol display areas. In this example, after a spin of the reels, two of the WILD symbols are positioned at horizontal symbol display areas. Accordingly, the gaming system displays the non-displayed WILD symbol of the group at one of the symbol display areas at which one of the WILD symbols is already displayed.

In one embodiment, when more than one symbol display area displays one of the group of designated symbols, the gaming system determines one of those symbol display areas at which to display the entire group of designated symbols. After doing so, the gaming system displays the entire group of designated symbols at that determined symbol display area, and removes the designated symbols from the symbol display areas that were not selected such that those symbol display areas are empty. The gaming system then performs a cascading symbols or tumbling reels feature, such as the example tumbling reels feature described in U.S. Patent Application No. 2010/0004050.

FIG. 1 illustrates a flowchart of an example process or method 100 for operating a gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In this example, the gaming system enables a player to initiate a play of game, as indicated by block 102. The game includes a plurality of reels. Each of the reels is associated with a plurality of symbol display areas and includes a plurality of symbols. The symbols of at least a first one of the reels include a plurality of designated symbols adjacent to one another on the first one of the reels, forming a group of designated symbols. For each of the reels, the gaming system displays a plurality of the symbols on that reel at the symbol display areas associated with that reel, as indicated by block 104. The gaming system determines whether at least a first quantity of the designated symbols of the group of designated symbols but less than a second greater quantity of the designated symbols of the group of designated symbols is displayed at one or more of the symbol display areas associated with the first one of the reels, as indicated by diamond 106. If the gaming system determines that the first quantity of the designated symbol is not displayed at the one or more of the symbol display areas associated with the first one of the reels, the gaming system determines, based on the displayed symbols, any awards for any displayed winning combinations of the symbols, as indicated by block 108. Process 100 proceeds to block 114, described below.

If the gaming system determines that the first quantity of the designated symbols is displayed at the one or more of the symbol display areas associated with the first one of the reels, the gaming system displays one or more other designated symbols of the group of designated symbols at the one or more of the symbol display areas associated with the first one of the reels in addition to the displayed designated symbols of the group of designated symbols such that the second greater quantity of the designated symbols is displayed, as indicated by block 110. The gaming system determines, based on the displayed symbols including the displayed designated symbols of the second greater quantity of the designated symbols, any awards for any displayed winning combinations of the symbols, as indicated by block 112. The gaming system displays and provides any determined awards, as indicated by block 114.

FIGS. 2A, 2B, 2C, 2D, 2E, 2F, 2G, 2H, and 2I illustrate screen shots of an example of a gaming system of one embodiment of the present disclosure. The gaming system is configured to operate a play of a spinning reel type primary wagering game upon a wager by a player. In this example, the gaming system includes a display device 210 that displays a plurality of reels 230*a*, 230*b*, 230*c*, 230*d*, and 230*e*, each of which includes a plurality of symbols. In this example, the symbols on reel 230*a* include three WILD symbols positioned adjacent to one another on reel 230*a* to form a first stack of WILD symbols; the symbols on reel 230*b* include four WILD symbols positioned adjacent to one another on reel 230*b* to form a second stack of WILD symbols; and the symbols on reel 230*d* include three WILD symbol portions positioned adjacent to one another on reel 230*e* to form a third stack of WILD symbols that, when viewed collectively, form a single resultant cohesive WILD symbol configured to be displayed at three adjacent symbol display positions.

Display device 210 also displays a plurality of symbol display areas 220*a*, 220*b*, 220*c*, 220*d*, 220*e*, 220*f*, 220*g*, 220*h*, 220*i*, 220*j*, 220*k*, 220*l*, 220*m*, 220*n*, and 220*o*. Each of the reels is associated with a plurality of the symbol display areas such that that reel is configured to display one of the symbols on that reel at each of the symbol display areas with which that reel is associated. In this example, reel 230*a* is associated with, and configured to display symbols at, symbol display areas 220*a*, 220*f*, and 220*k*; reel 230*b* is associated with, and configured to display symbols at, symbol display areas 220*b*, 220*g*, and 220*l*; reel 230*c* is associated with, and configured to display symbols at, symbol display areas 220*c*, 220*h*, and 220*m*; reel 230*d* is associated with, and configured to display symbols at, symbol display areas 220*d*, 220*i*, and 220*n*; and reel 230*e* is associated with, and configured to display symbols at, symbol display areas 220*e*, 220*j*, and 220*o*.

Display device 210 displays a plurality of paylines for the primary wagering game, each of which is associated with a different plurality of the symbol display areas. Specifically, payline A 215*a* is associated with symbol display areas 220*a*, 220*b*, 220*c*, 220*d*, and 220*e*; payline B 215*b* is associated with symbol display areas 220*a*, 220*b*, 220*h*, 220*n*, and 220*o*; payline C 215*c* is associated with symbol display areas 220*f*, 220*g*, 220*h*, 220*i*, and 220*j*; payline D 215*d* is associated with symbol display areas 220*k*, 220*l*, 220*h*, 220*d*, and 220*e*; and payline E 215*e* is associated with symbol display areas 220*k*, 220*l*, 220*m*, 220*n*, and 220*o*. Payline A 215*a*, payline B 215*b*, payline C 215*c*, payline D 215*d*, and payline E 215*e* are sometimes referred to herein as paylines A, B, C, D, and E.

Display device 210 displays a paytable 212 for the primary wagering game, wherein paytable 212 includes a plurality of winning symbol combinations and the credit payout associated with each respective winning symbol combination. Specifically, in this example, paytable 212 includes the credit payout associated with each respective winning symbol combination when the maximum wager, which is 50 credits in this example (but could be any suitable amount), is placed for a play of the primary wagering game. Specifically, winning symbol combination SEVEN-SEVEN-SEVEN-SEVEN-SEVEN is associated with an award of 10,000 credits; winning symbol combination DIAMOND-DIAMOND-DIAMOND-DIAMOND is associated with an award of 7,500 credits, winning symbol combination DOLLAR SIGN-DOLLAR SIGN-DOLLAR SIGN-DOLLAR SIGN-DOLLAR SIGN is associated with an award of 5,000 credits; winning symbol combination TRIPLE BAR-TRIPLE BAR-TRIPLE BAR-TRIPLE BAR is associated with an award of 2,000 credits; winning symbol combination ORANGE-ORANGE-ORANGE-ORANGE is associated with an award of 500 credits; winning symbol combination DOUBLE BAR-DOUBLE BAR-DOUBLE BAR is associated with an award of 375 credits; winning symbol combination TRIPLE CHERRY-TRIPLE CHERRY-TRIPLE CHERRY is associated with an award of 250 credits; winning symbol combination BAR-BAR-BAR is associated with an award of 100 credits; and winning symbol combination CHERRY-CHERRY-CHERRY is associated with an award of 50 credits.

In this example, display device 210 also displays an indication, notification, or message display area 211, which displays information, notifications, and/or messages before, during, or after play of the primary wagering game; a credit meter 214, which displays a credit balance of the player; a wager indicator or display 216, which displays any wager placed for a play of the primary wagering game; and an award indicator or display 218, which displays any determined awards for a play of the primary wagering game.

It should be appreciated that, in various embodiments: (a) the primary wagering game may include, and the display device may display, any suitable quantity of symbol display areas in any suitable configuration or arrangement; (b) each of the reels may be associated with any suitable quantity of the symbol display areas; (c) the primary wagering game may include, and the display device may display, any suitable quantity of paylines for the primary wagering game; (d) each of the displayed paylines may be associated with any suitable quantity of the symbol display areas and any suitable combination of the symbol display areas; (e) the gaming system may use any other suitable award determination other than a payline evaluation, such as a ways to win and/or a scatter pay award determination (as described below); (f) the paytable may be modified to reflect lower credit payouts when a wager that is less than the maximum wager is placed on a play of the primary wagering game; (g) any suitable paytable including any suitable quantity of winning symbol combinations may be employed; (h) any suitable combination of the symbols may be used as a winning symbol combination; (i) the winning symbol combinations may be associated with any suitable credit payouts; (j) any suitable quantity of paytables may be utilized; and (k) any suitable symbols may be employed and may include, for example, any suitable markings or indicia such as letters, numbers, or illustrations or pictures of objects.

Figure 2A:
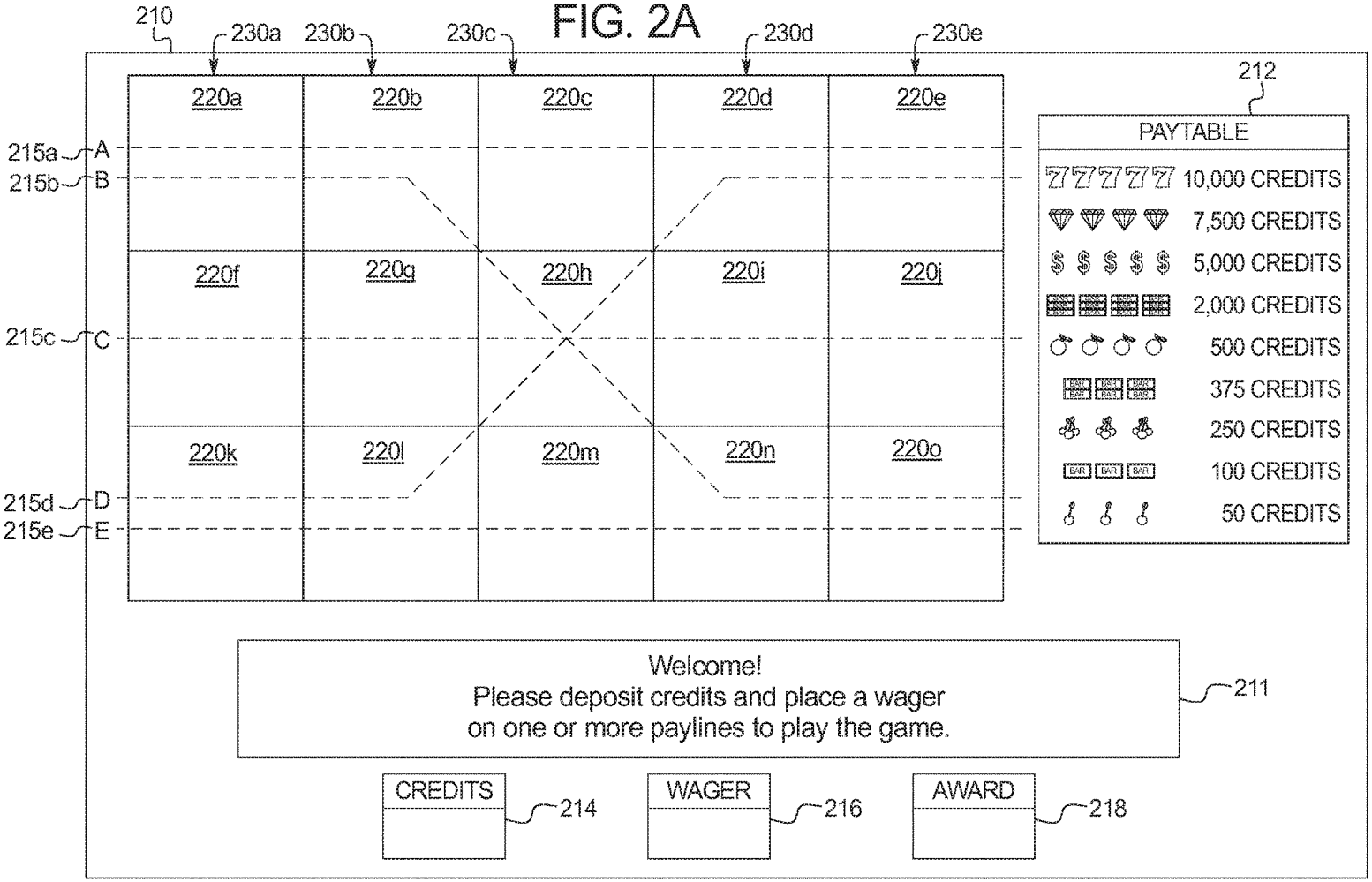
FIGS. 2A, 2B, 2C, 2D, 2E, 2F, 2G, 2H, and 2I illustrate screen shots of an example of an embodiment of the gaming system of the present disclosure in which the gaming system displays a portion of each of three different symbol stacks and subsequently displays additional symbols of those symbol stacks such that the entire symbol stacks are displayed.

As illustrated in FIG. 2A, in this example, when the gaming system is not being played, message display area 211 displays a message that invites a player to deposit value (e.g., insert currency or a redeemable ticket having a cash value into a payment acceptor of the gaming system, as further described below) to fund the gaming system and to place a wager on one or more of the paylines to play the primary wagering game.

Figure 2B:
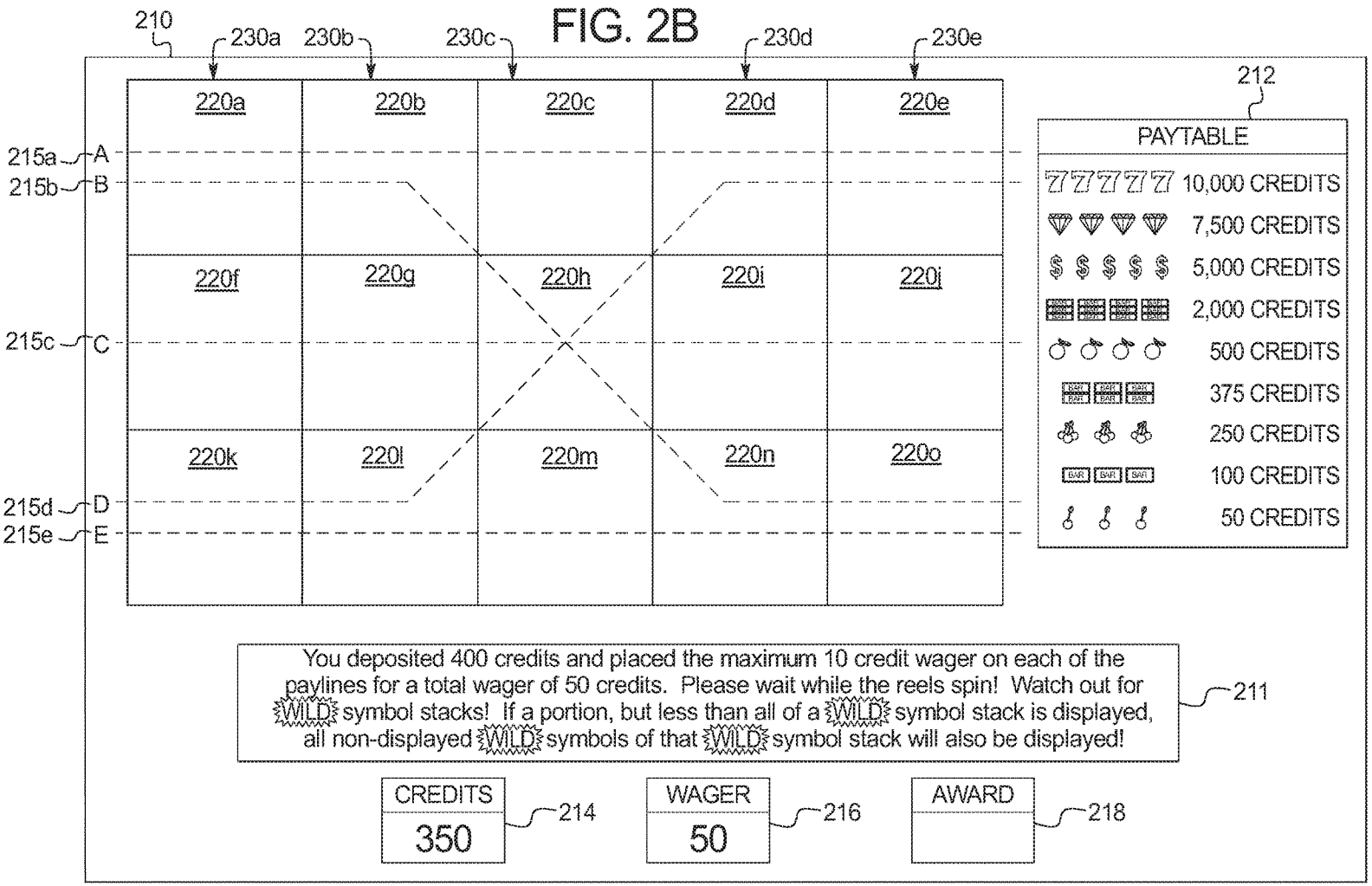

As illustrated in FIG. 2B, a player funded the gaming system by depositing value. The gaming system provided the player with 400 credits, which represent the deposited value in this example. The player subsequently placed the maximum wager of 50 credits. Placement of the maximum wager activates each of paylines A, B, C, D, and E for a play of the primary wagering game. Wager indicator 216 displays the player's wager of 50 credits. Credit meter 214 displays the player's total remaining credit balance of 350 credits (i.e., the player's initial credit balance of 400 credits minus the player's wager of 50 credits). Message display area 211 displays a message notifying the player to watch for WILD symbol stacks, and that if a portion, but less than all, of a WILD symbol stack is displayed, all of the non-displayed WILD symbols of that WILD symbol stack will be displayed in addition to the already displayed WILD symbols of that WILD symbol stack.

Figure 2C:
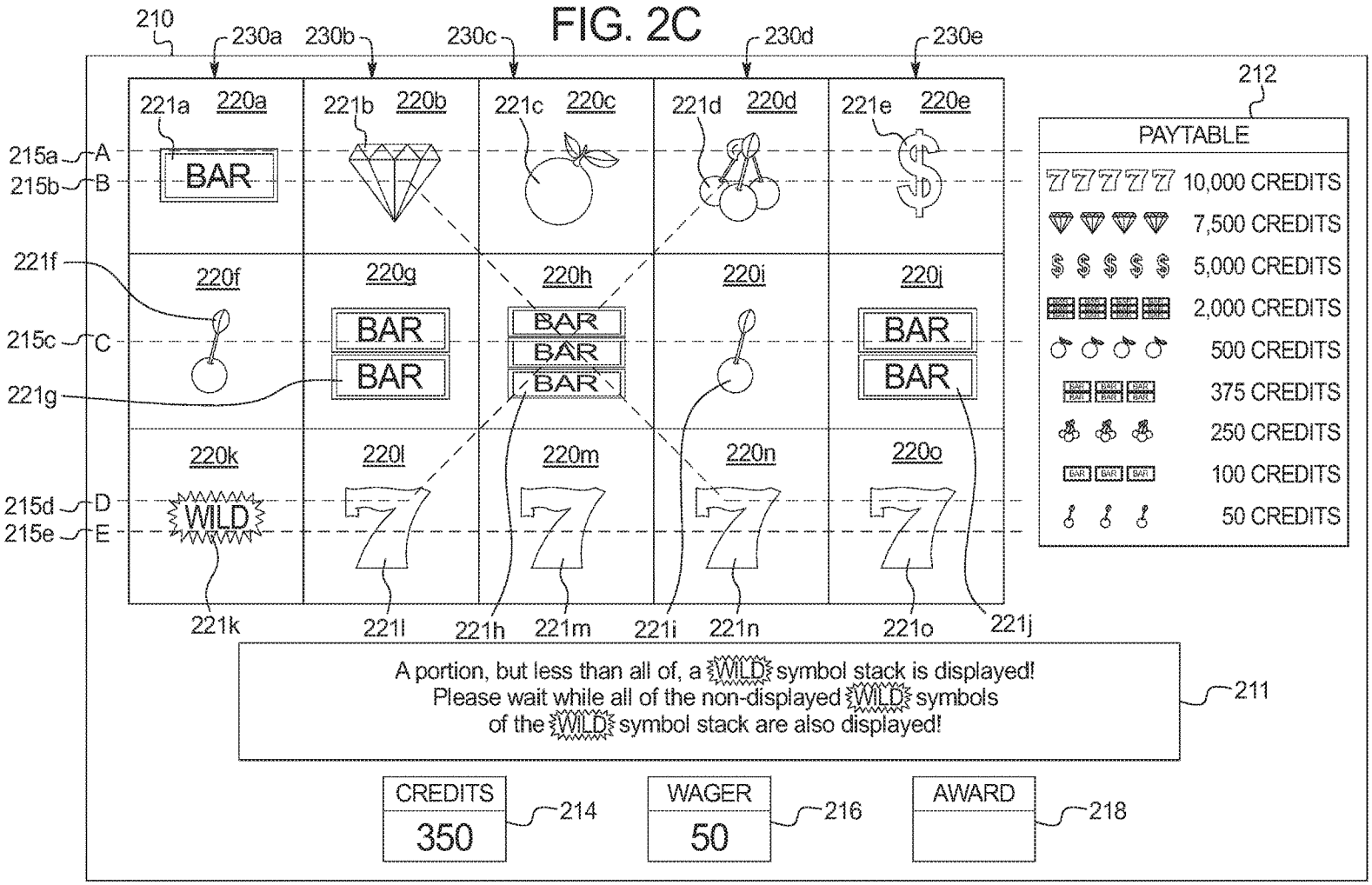

As illustrated in FIG. 2C, upon initiation of a play of the primary wagering game, the gaming system determined and displayed an outcome for the play of the primary wagering game. Specifically, the gaming system: (a) spun reel 230*a* and displayed BAR symbol 221*a* at symbol display area 220*a*, CHERRY symbol 221*f* at symbol display area 220*f*, and WILD symbol 221*k* at symbol display area 220*k*; (b) spun reel 230*b* and displayed DIAMOND symbol 221*b* at symbol display area 220*b*, DOUBLE BAR symbol 221*g* at symbol display area 220*g*, and SEVEN symbol 221*l* at symbol display area 220*l*; (c) spun reel 230*c* and displayed ORANGE symbol 221*c* at symbol display area 220*c*, TRIPLE BAR symbol 221*h* at symbol display area 220*h*, and SEVEN symbol 221*m* at symbol display area 220*m*; (d) spun reel 230*d* and displayed TRIPLE CHERRY symbol 221*d* at symbol display area 220*d*, CHERRY symbol 221*i* at symbol display area 220*i*, and SEVEN symbol 221*n* at symbol display area 220*n*; and (e) spun reel 230*e* and displayed DOLLAR SIGN symbol 221*e* at symbol display area 220*e*, DOUBLE BAR symbol 221*j* at symbol display area 220*j*, and SEVEN symbol 221*o* at symbol display area 220*o*.

After spinning the reels and displaying symbols at each of the symbol display areas, the gaming system determines: (a) whether one or two of the WILD symbols of the first stack of WILD symbols on reel 230*a* are displayed at symbol display areas 220*a*, 220*f*, and/or 220*k* (i.e., whether at least the first quantity of the WILD symbols (one) of the first stack of WILD symbols but less than the second greater quantity of the WILD symbols (three) of the first stack of WILD symbols is displayed); (b) whether one, two, or three of the WILD symbols of the second stack of WILD symbols on reel 230*b* are displayed at symbol display areas 220*b*, 220*g*, and/or 220*l* (i.e., whether at least the first quantity of the WILD symbols (one) of the second stack of WILD symbols but less than the second greater quantity of the WILD symbols (four) of the second stack of WILD symbols is displayed); and (c) whether one or two of the WILD symbol portions of the third stack of WILD symbols on reel 230*e* are displayed at symbol display areas 220*e*, 220*j*, and/or 220*o* (i.e., whether at least the first quantity of the WILD symbol portions (one) of the third stack of WILD symbols but less than the second greater quantity of the WILD symbol portions (three) of the third stack of WILD symbols is displayed). As indicated by the message displayed in message display area 211, in this example, one of the WILD symbols of the first stack of WILD symbols on reel 230*a*—WILD symbol 221*k*—is displayed at symbol display area 220*k*. In this example, when a portion, but less than all, of the first stack of WILD symbols is displayed, the gaming system displays, in addition to the displayed WILD symbols of the first stack of WILD symbols, each of the non-displayed WILD symbols of the first stack of WILD symbols at each of the symbol display areas at which the WILD symbols of the first stack of WILD symbols are already displayed.

Figure 2D:
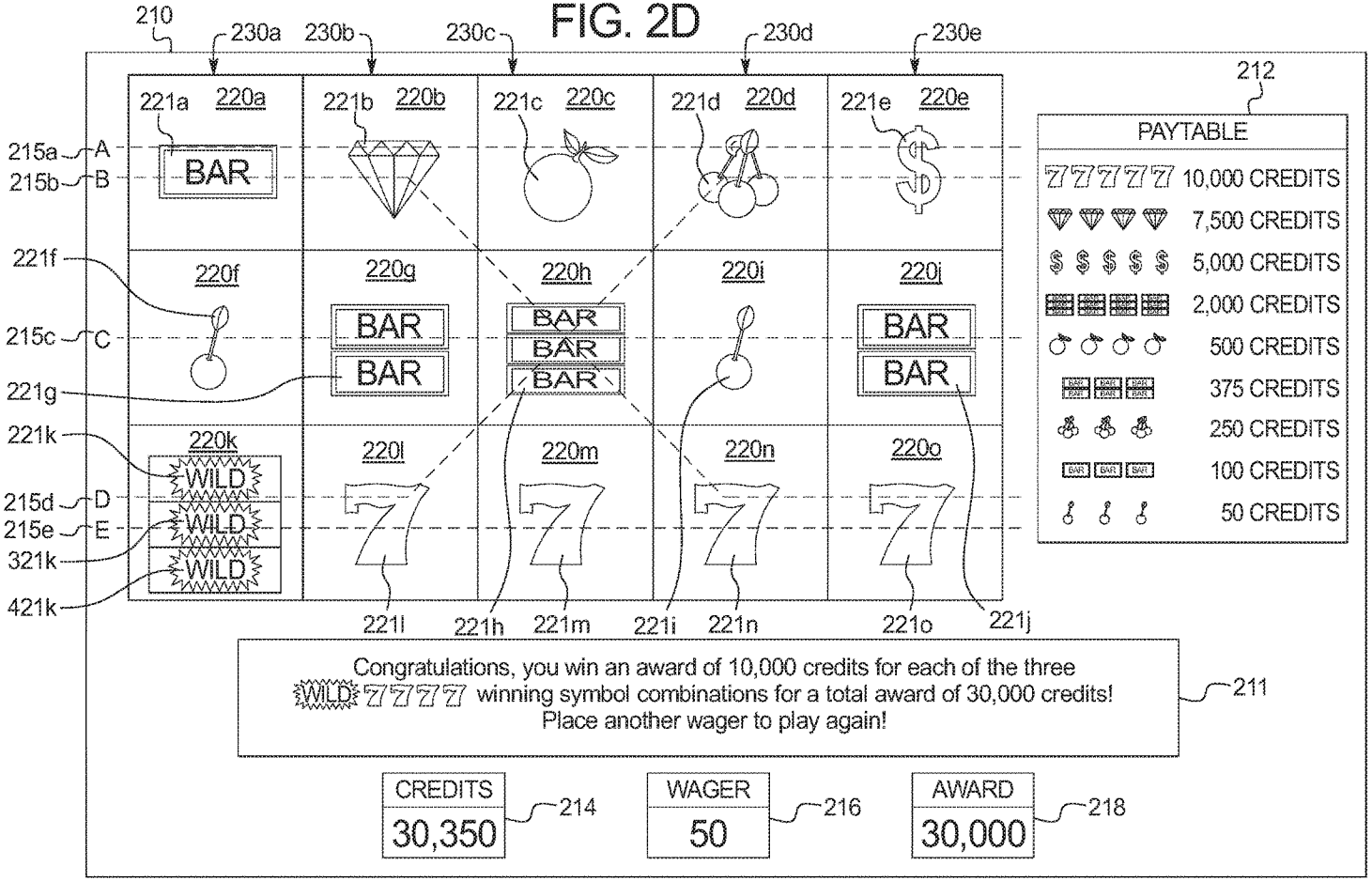

Accordingly, as illustrated in FIG. 2D, the gaming system displays the remaining two WILD symbols of the first stack of WILD symbols that were not initially displayed—WILD symbols 321*k* and 431*k*—at symbol display area 230*k* in addition to WILD symbol 221*k* such that a second greater quantity (i.e., three) of the WILD symbols of the first stack of WILD symbols is displayed. After displaying the additional WILD symbols of the first stack of WILD symbols, the gaming system makes an award determination. That is, the gaming system determines whether the displayed symbols form any of the winning symbol combinations included in paytable 212 along wagered-on paylines A, B, C, D, and/or E. In this example, when more than one of the WILD symbols of the first stack of WILD symbols are displayed at one of the symbol display areas, the gaming system makes separate award determinations for each of the WILD symbols of the first stack of the WILD symbols displayed at that symbol display area. In this example, symbol display area 220*k* is associated with paylines D and E. Thus, the gaming system makes: (a) an award determination associated with payline D for WILD symbols 221*k*, (b) an award determination associated with payline E for WILD symbol 221*k*, (c) an award determination associated with payline D for WILD symbol 321*k*, (d) an award determination associated with payline E for WILD symbol 321*k*, (e) an award determination associated with payline D for WILD symbol 421*k*, and (f) an award determination associated with payline E for WILD symbol 421*k*.

As indicated by the message displayed in message display area 211, in this example the gaming system determined an award of 10,000 credits for each of: (a) the WILD-SEVEN-SEVEN-SEVEN-SEVEN winning symbol combination (which is considered to be the SEVEN-SEVEN-SEVEN-SEVEN-SEVEN winning symbol combination by virtue of the WILD symbol) formed by WILD symbol 221*k*, SEVEN symbol 221*l*, SEVEN symbol 221*m*, SEVEN symbol 221*n*, and SEVEN symbol 221*o* displayed from left to right along payline E; (b) the WILD-SEVEN-SEVEN-SEVEN-SEVEN winning symbol combination (which is considered to be the SEVEN-SEVEN-SEVEN-SEVEN-SEVEN winning symbol combination by virtue of the WILD symbol) formed by WILD symbol 321*k*, SEVEN symbol 221*l*, SEVEN symbol 221*m*, SEVEN symbol 221*n*, and SEVEN symbol 221*o* displayed from left to right along payline E; and (c) the WILD-SEVEN-SEVEN-SEVEN-SEVEN winning symbol combination (which is considered to be the SEVEN-SEVEN-SEVEN-SEVEN-SEVEN winning symbol combination by virtue of the WILD symbol) formed by WILD symbol 421*k*, SEVEN symbol 221*l*, SEVEN symbol 221*m*, SEVEN symbol 221*n*, and SEVEN symbol 221*o* displayed from left to right along payline E. Award indicator 218 displays the total award of 30,000 credits, and the player's credit balance indicated by credit meter 214 is updated to reflect the player's 30,000 credit award such that the player's total credit balance is 30,350 credits.

Figure 2E:
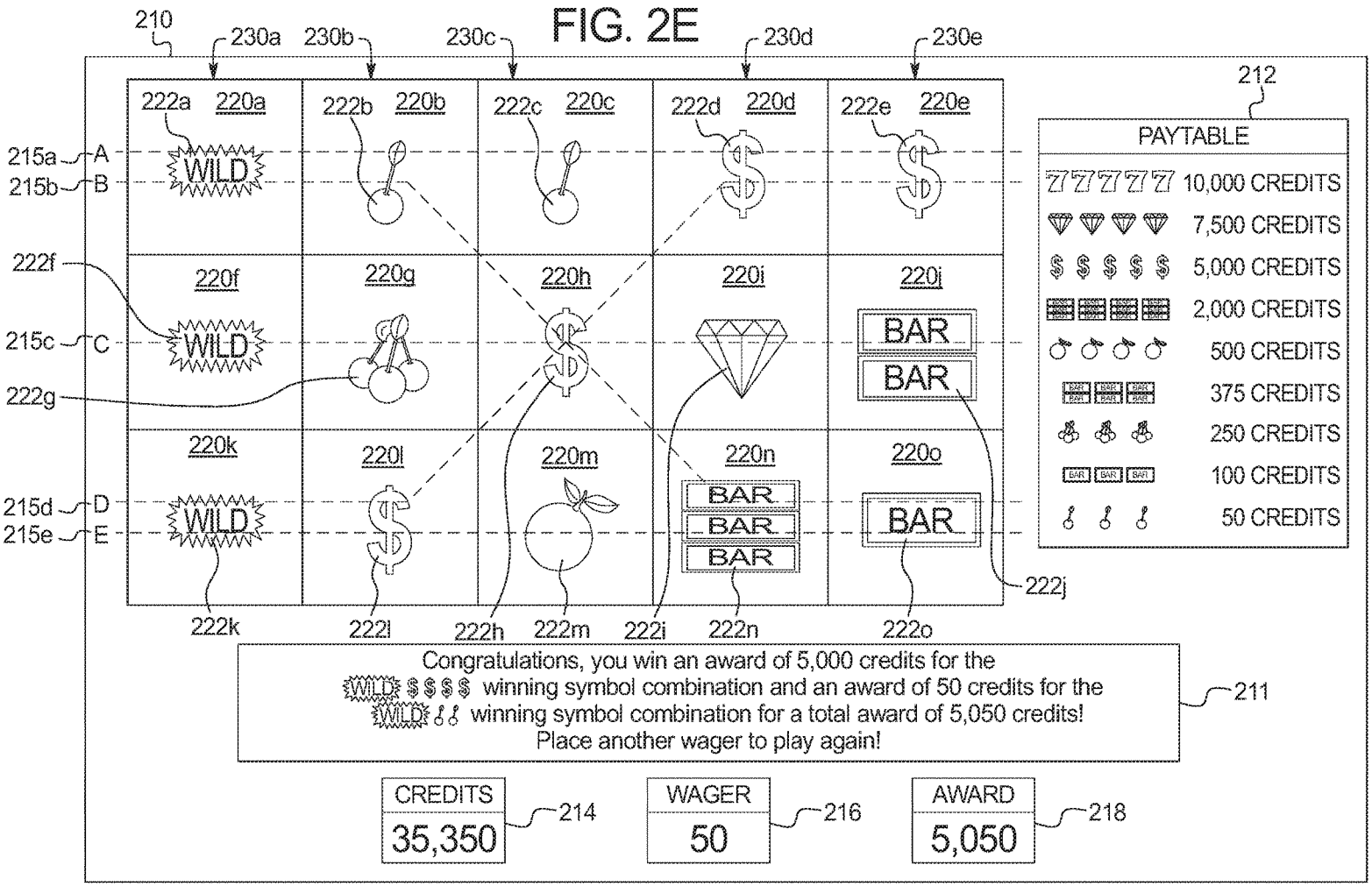

FIG. 2E illustrates a screen shot of display device 210 following a spin of the reels for a subsequent play of the primary wagering game on which the player wagered 50 credits, as indicated by wager indicator 216. Specifically, the gaming system: (a) spun reel 230*a* and displayed WILD symbol 222*a* at symbol display area 220*a*, WILD symbol 222*f* at symbol display area 220*f*, and WILD symbol 222*k* at symbol display area 220*k*; (b) spun reel 230*b* and displayed CHERRY symbol 222*b* at symbol display area 220*b*, TRIPLE CHERRY symbol 222*g* at symbol display area 220*g*, and DOLLAR SIGN symbol 222*l* at symbol display area 220*l*; (c) spun reel 230*c* and displayed CHERRY symbol 222*c* at symbol display area 220*c*, DOLLAR SIGN symbol 222*h* at symbol display area 220*h*, and ORANGE symbol 222*m* at symbol display area 220*m*; (d) spun reel 230*d* and displayed DOLLAR SIGN symbol 222*d* at symbol display area 220*d*, DIAMOND symbol 222*i* at symbol display area 220*i*, and TRIPLE BAR symbol 222*n* at symbol display area 220*n*; and (e) spun reel 230*e* and displayed DOLLAR SIGN symbol 222*e* at symbol display area 220*e*, DOUBLE BAR symbol 222*j* at symbol display area 220*j*, and BAR symbol 222*o* at symbol display area 220*o*.

After spinning the reels and displaying symbols at each of the symbol display areas, the gaming system determines: (a) whether one or two of the WILD symbols of the first stack of WILD symbols on reel 230*a* are displayed at symbol display areas 220*a*, 220*f*, and/or 220*k*; (b) whether one, two, or three of the WILD symbols of the second stack of WILD symbols on reel 230*b* are displayed at symbol display areas 220*b*, 220*g*, and/or 220*l*; and (c) whether one or two of the WILD symbol portions of the third stack of WILD symbols on reel 230*e* are displayed at symbol display areas 220*e*, 220*j*, and/or 220*o*. As indicated by the message displayed in message display area 211, in this example, each of the three WILD symbols of the first stack of WILD symbols on reel 230*a*—WILD symbols 222*a*, 222*f*, and 222*k*—is displayed at a separate symbol display area—symbol display areas 220*a*, 220*f*, and 220*k*, respectively. In this example, since all of the WILD symbols of the first stack of WILD symbols are displayed (i.e., since the entire first stack of WILD symbols is displayed), the gaming system does not display any additional WILD symbols of the first stack of WILD symbols.

Accordingly, the gaming system makes an award determination; that is, the gaming system determines whether the displayed symbols form any of the winning symbol combinations included in paytable 212 along wagered-on paylines A, B, C, D, and/or E. As indicated by the message displayed in message display area 211, in this example the gaming system determined an award of 5,000 credits for the WILD-DOLLAR SIGN-DOLLAR SIGN-DOLLAR SIGN-DOLLAR SIGN winning symbol combination (which is considered to be the DOLLAR SIGN-DOLLAR SIGN-DOLLAR SIGN-DOLLAR SIGN-DOLLAR SIGN winning symbol combination by virtue of the WILD symbol) formed by WILD symbol 222*k*, DOLLAR SIGN symbol 222*l*, DOLLAR SIGN symbol 222*h*, DOLLAR SIGN symbol 222*d*, and DOLLAR SIGN symbol 222*e* displayed from left to right along payline D; and an award of 50 credits for the WILD-CHERRY-CHERRY winning symbol combination (which is considered to be the CHERRY-CHERRY-CHERRY winning symbol combination) formed by WILD symbol 222*a*, CHERRY symbol 222*b*, and CHERRY symbol 222*c* displayed from left to right along payline A. Award indicator 218 displays the total award of 5,050 credits, and the player's credit balance indicated by credit meter 214 is updated to reflect the player's 5,050 credit award such that the player's total credit balance is 35,350 credits.

Figure 2F:
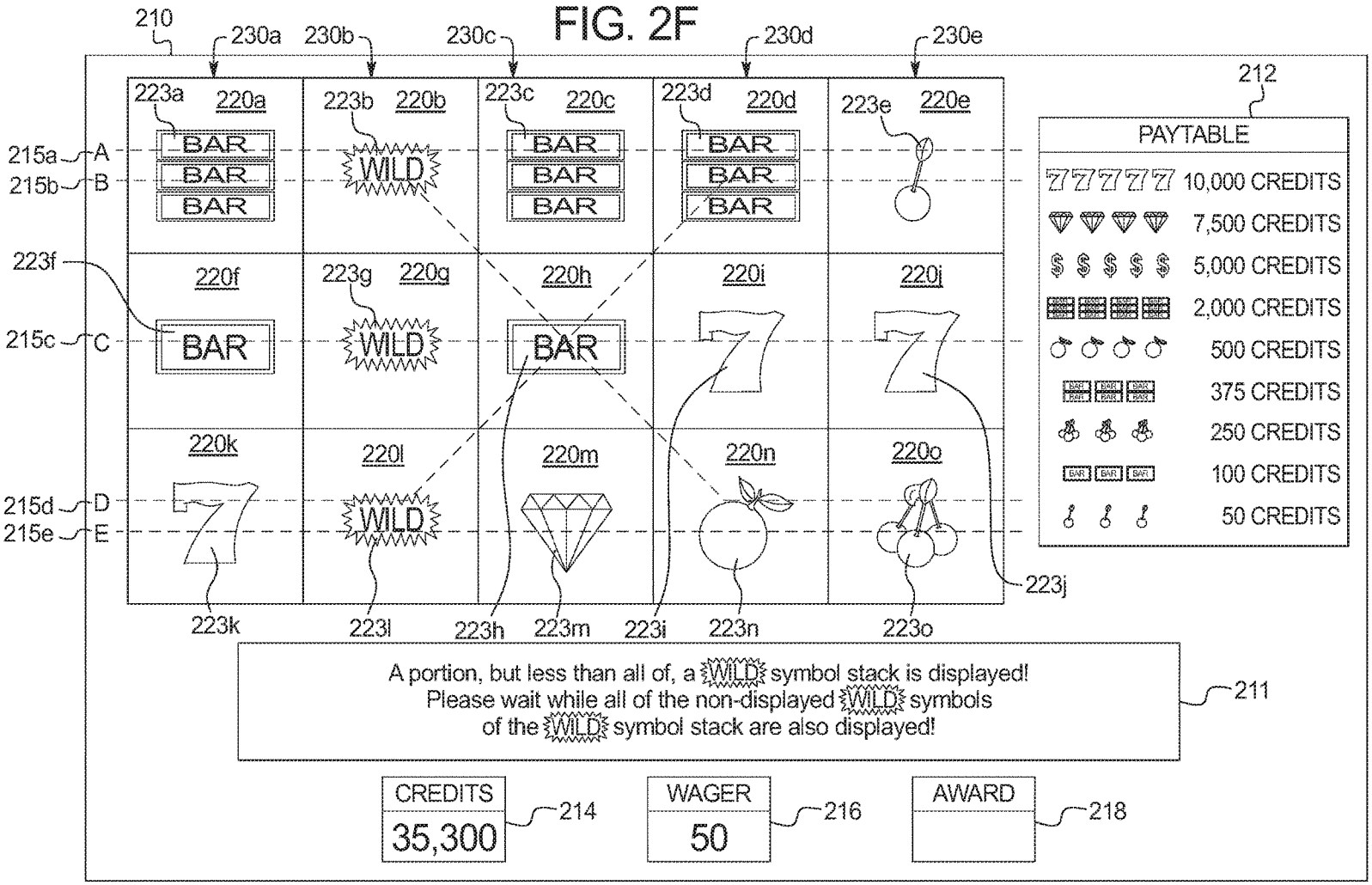

FIG. 2F illustrates a screen shot of display device 210 following a spin of the reels for a subsequent play of the primary wagering game on which the player wagered 50 credits, as indicated by wager indicator 216. Specifically, the gaming system: (a) spun reel 230*a* and displayed TRIPLE BAR symbol 223*a* at symbol display area 220*a*, BAR symbol 223*f* at symbol display area 220*f*, and SEVEN symbol 223*k* at symbol display area 220*k*; (b) spun reel 230*b* and displayed WILD symbol 223*b* at symbol display area 220*b*, WILD symbol 223*g* at symbol display area 220*g*, and WILD symbol 223*l* at symbol display area 220*l*; (c) spun reel 230*c* and displayed TRIPLE BAR symbol 223*c* at symbol display area 220*c*, BAR symbol 223*h* at symbol display area 220*h*, and DIAMOND symbol 223*m* at symbol display area 220*m*; (d) spun reel 230*d* and displayed TRIPLE BAR symbol 223*d* at symbol display area 220*d*, SEVEN symbol 223*i* at symbol display area 220*i*, and ORANGE symbol 223*n* at symbol display area 220*n*; and (e) spun reel 230*e* and displayed CHERRY symbol 223*e* at symbol display area 220*e*, SEVEN symbol 223*j* at symbol display area 220*j*, and TRIPLE CHERRY symbol 223*o* at symbol display area 220*o*.

After spinning the reels and displaying symbols at each of the symbol display areas, the gaming system determines: (a) whether one or two of the WILD symbols of the first stack of WILD symbols on reel 230*a* are displayed at symbol display areas 220*a*, 220*f*, and/or 220*k*; (b) whether one, two, or three of the WILD symbols of the second stack of WILD symbols on reel 230*b* are displayed at symbol display areas 220*b*, 220*g*, and/or 220*l*; and (c) whether one or two of the WILD symbol portions of the third stack of WILD symbols on reel 230*e* are displayed at symbol display areas 220*e*, 220*j*, and/or 220*o*. As indicated by the message displayed in message display area 211, in this example, three of the four WILD symbols of the second stack of WILD symbols on reel 230*b*—WILD symbols 223*b*, 223*g*, and 223*l*—are displayed at the symbol display areas associated with reel 230*b*—symbol display areas 220*b*, 220*g*, and 220*l*, respectively. In this example, when a portion, but less than all, of the second stack of WILD symbols is displayed, the gaming system: (a) randomly selects one of symbol display areas 220*b*, 220*g*, and 220*l* at which one of the WILD symbols of the second stack of WILD symbols is displayed; and (b) displays, in addition to the WILD symbol of the second stack of WILD symbols displayed at the randomly selected symbol display area, each of the non-displayed WILD symbols of the second stack of WILD symbols.

Figure 2G:
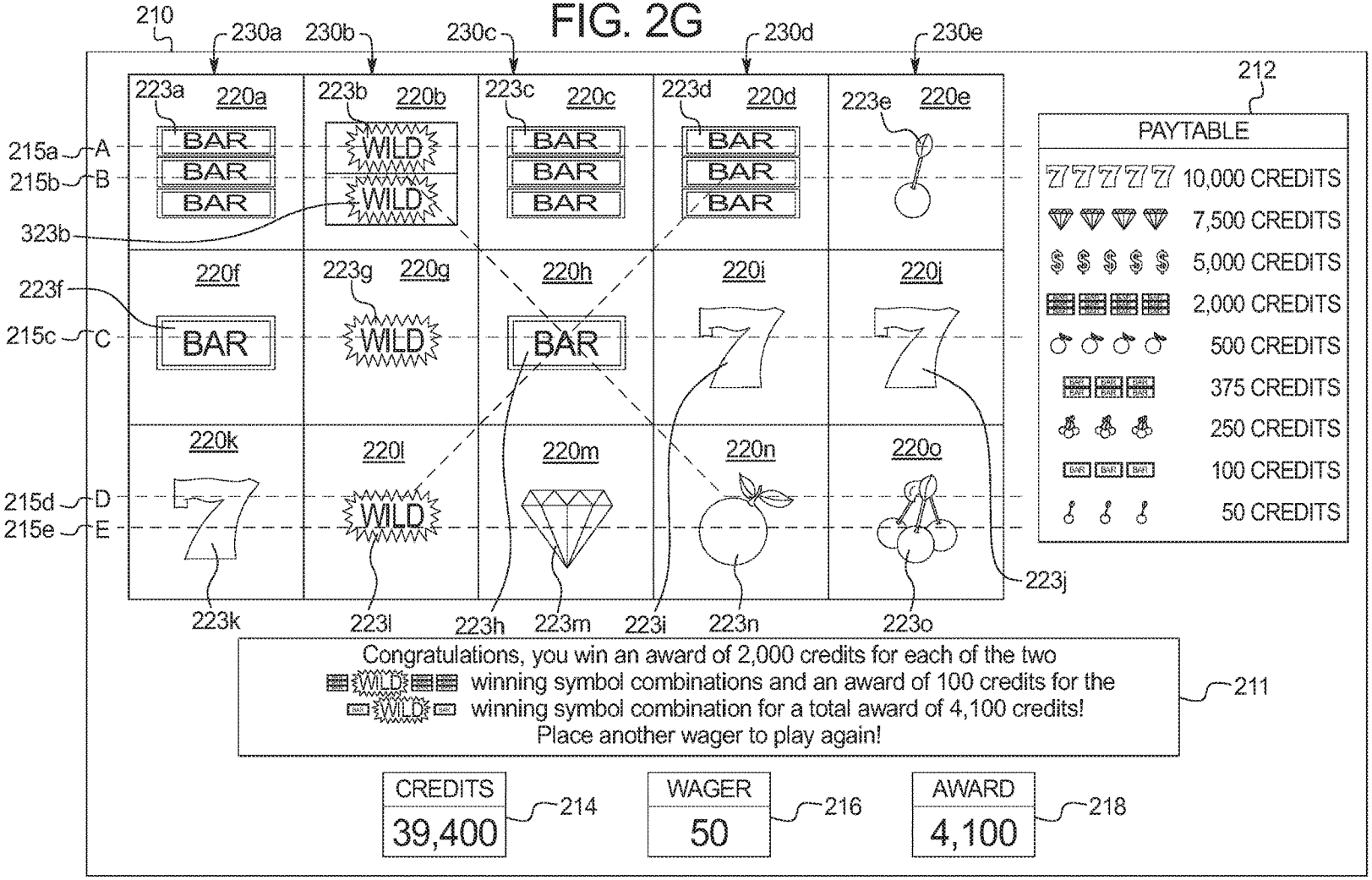

As illustrated in FIG. 2G, the gaming system: (a) randomly selected symbol display area 220*b*, and (b) displayed the remaining WILD symbol of the second stack of WILD symbols that was not initially displayed WILD symbol 323*b*—at symbol display area 220*b* in addition to WILD symbol 223*b* such that a second greater quantity (i.e., four) of the WILD symbols of the second stack of WILD symbols is displayed. After displaying the additional WILD symbol of the second stack of WILD symbols, the gaming system makes an award determination. That is, the gaming system determines whether the displayed symbols form any of the winning symbol combinations included in paytable 212 along wagered-on paylines A, B, C, D, and/or E. In this example, when more than one of the WILD symbols of the second stack of WILD symbols are displayed at one of the symbol display areas, the gaming system makes separate award determinations for each of the WILD symbols of the second stack of the WILD symbols displayed at that symbol display area. In this example, symbol display area 220*b* is associated with payline A. Thus, the gaming system makes: (a) an award determination associated with payline A for WILD symbol 223*b*, and (b) a separate award determination associated with payline A for WILD symbol 323*b*.

As indicated by the message displayed in message display area 211, in this example the gaming system determined an award of 2,000 credits for the TRIPLE BAR-WILD-TRIPLE BAR-TRIPLE BAR winning symbol combination (which is considered to be the TRIPLE BAR-TRIPLE BAR-TRIPLE BAR-TRIPLE BAR winning symbol combination by virtue of the WILD symbol) formed by TRIPLE BAR symbol 223*a*, WILD symbol 223*b*, TRIPLE BAR symbol 223*c*, and TRIPLE BAR symbol 223*d* displayed from left to right along payline A; an award of 2,000 credits for the TRIPLE BAR-WILD-TRIPLE BAR-TRIPLE BAR winning symbol combination (which is considered to be the TRIPLE BAR-TRIPLE BAR-TRIPLE BAR-TRIPLE BAR winning symbol combination by virtue of the WILD symbol) formed by TRIPLE BAR symbol 223*a*, WILD symbol 323*b*, TRIPLE BAR symbol 223*c*, and TRIPLE BAR symbol 223*d* displayed from left to right along payline A; and an award of 100 credits for the BAR-WILD-BAR winning symbol combination formed by BAR symbol 223*f*, WILD symbol 223*g*, and BAR symbol 223*h* displayed from left to right along payline C. Award indicator 218 displays the total award of 4,100 credits, and the player's credit balance indicated by credit meter 214 is updated to reflect the player's 4,100 credit award such that the player's total credit balance is 39,400 credits.

Figure 2H:
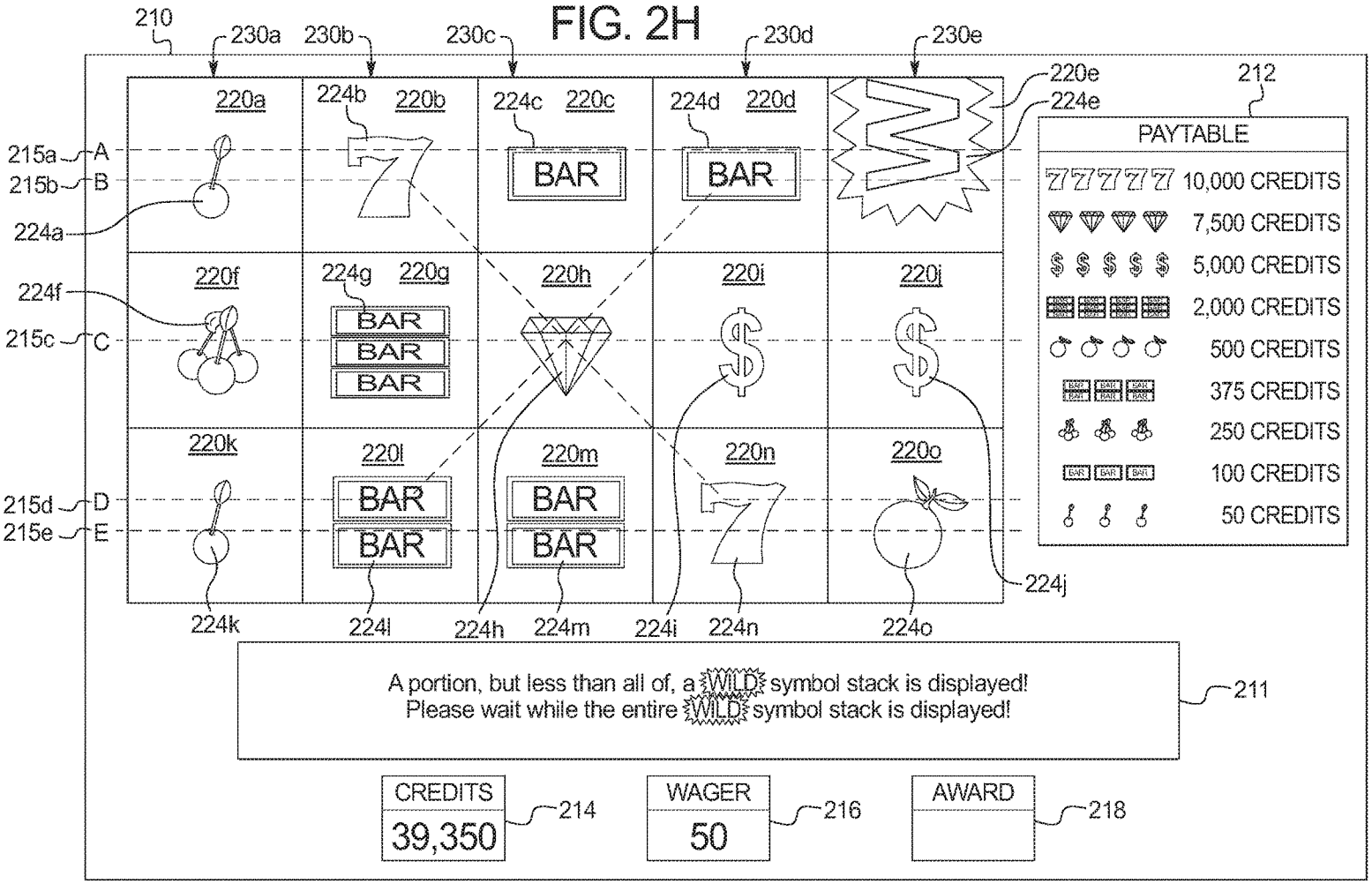

FIG. 2H illustrates a screen shot of display device 210 following a spin of the reels for a subsequent play of the primary wagering game on which the player wagered 50 credits, as indicated by wager indicator 216. Specifically, the gaming system: (a) spun reel 230*a* and displayed CHERRY symbol 224*a* at symbol display area 220*a*, TRIPLE CHERRY symbol 224*f* at symbol display area 220*f*, and CHERRY symbol 224*k* at symbol display area 220*k*; (b) spun reel 230*b* and displayed SEVEN symbol 224*b* at symbol display area 220*b*, TRIPLE BAR symbol 224*g* at symbol display area 220*g*, and DOUBLE BAR symbol 224*l* at symbol display area 220*l*; (c) spun reel 230*c* and displayed BAR symbol 224*c* at symbol display area 220*c*, DIAMOND symbol 224*h* at symbol display area 220*h*, and DOUBLE BAR symbol 224*m* at symbol display area 220*m*; (d) spun reel 230*d* and displayed BAR symbol 224*d* at symbol display area 220*d*, DOLLAR SIGN symbol 224*i* at symbol display area 220*i*, and SEVEN symbol 224*n* at symbol display area 220*n*; and (e) spun reel 230*e* and displayed WILD symbol portion 224*e* at symbol display area 220*e*, DOLLAR SIGN symbol 224*j* at symbol display area 220*j*, and ORANGE symbol 224*o* at symbol display area 220*o*.

After spinning the reels and displaying symbols at each of the symbol display areas, the gaming system determines: (a) whether one or two of the WILD symbols of the first stack of WILD symbols on reel 230*a* are displayed at symbol display areas 220*a*, 220*f*, and/or 220*k*; (b) whether one, two, or three of the WILD symbols of the second stack of WILD symbols on reel 230*b* are displayed at symbol display areas 220*b*, 220*g*, and/or 220*l*; and (c) whether one or two of the WILD symbol portions of the third stack of WILD symbols on reel 230*e* are displayed at symbol display areas 220*e*, 220*j*, and/or 220*o*. As indicated by the message displayed in message display area 211, in this example, one of the three WILD symbol portions of the third stack of WILD symbols on reel 230*e*—WILD symbol portion 224*e*—is displayed at the symbol display areas associated with reel 230*e*—symbol display area 220*e*. In this example, when a portion, but less than all, of the third stack of WILD symbols is displayed, the gaming system displays the entire third stack of WILD symbols at the symbol display area or areas at which the portion of the third stack of WILD symbols is displayed.

Figure 2I:
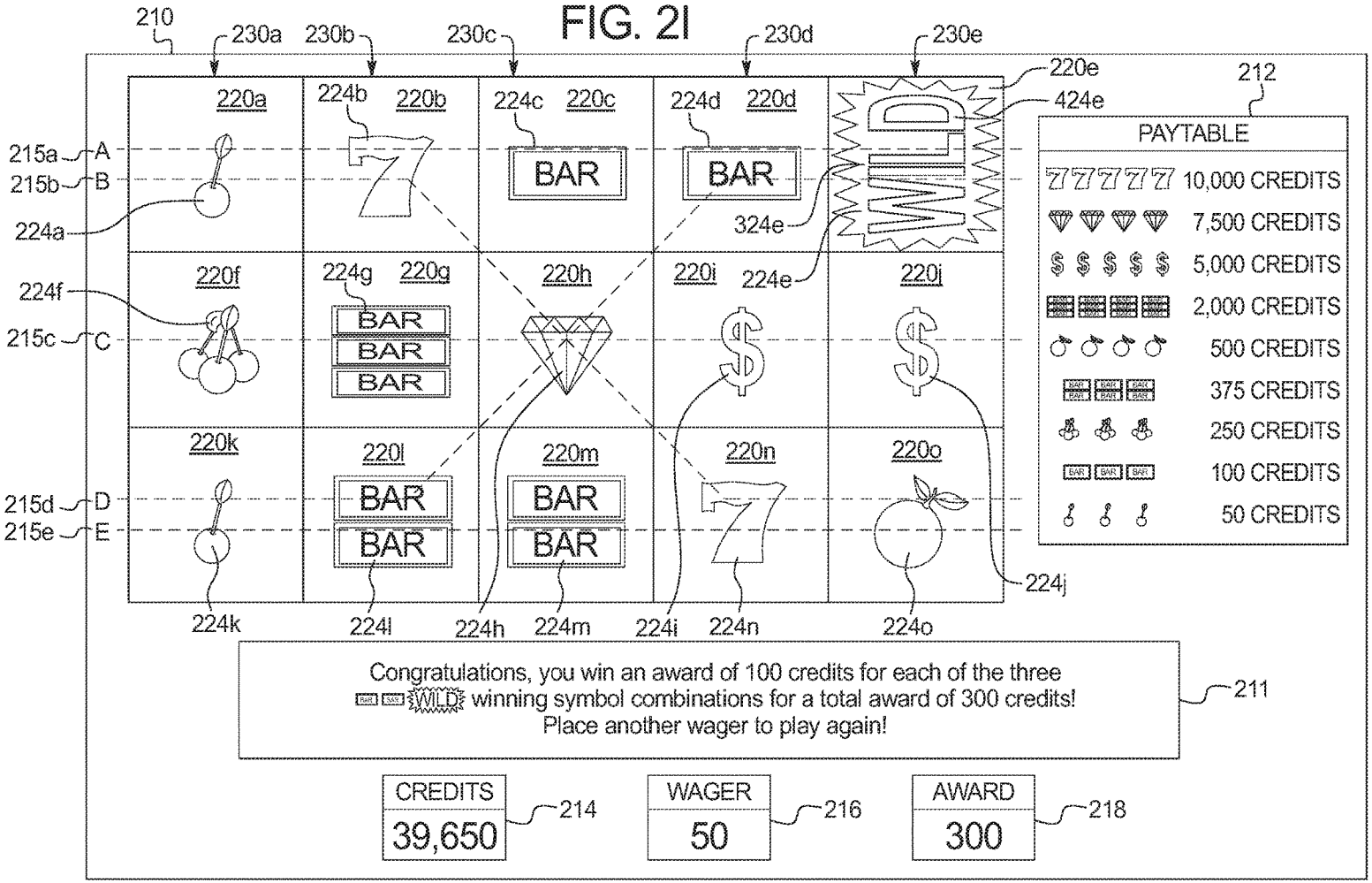

As illustrated in FIG. 2I, the gaming system displayed the entire third stack of WILD symbols, which comprises WILD symbol portions 224*e*, 324*e*, and 424*e*, at symbol display area 220*e* (i.e., the symbol display area at which the portion of the third stack of WILD symbols was displayed) such that a second greater quantity (i.e., three) of the WILD symbol portions of the third stack of WILD symbols is displayed. After displaying the additional WILD symbol portions of the third stack of WILD symbols, the gaming system makes an award determination. That is, the gaming system determines whether the displayed symbols form any of the winning symbol combinations included in paytable 212 along wagered-on paylines A, B, C, D, and/or E. In this example, when more than one of the WILD symbol portions of the third stack of WILD symbols are displayed at one of the symbol display areas, the gaming system makes separate award determinations for each of the WILD symbol portions of the third stack of the WILD symbols displayed at that symbol display area. In this example, symbol display area 220*e* is associated with paylines A and D. Thus, the gaming system makes: (a) an award determination associated with payline A for WILD symbol portion 224*e*, (b) a separate award determination associated with payline A for WILD symbol portion 324*e*, (c) a separate award determination associated with payline A for WILD symbol portion 424*e*, (d) a separate award determination associated with payline D for WILD symbol portion 224*e*, (e) a separate award determination associated with payline D for WILD symbol portion 324*e*, and (f) a separate award determination associated with payline D for WILD symbol portion 424*e*.

As indicated by the message displayed in message display area 211, in this example the gaming system determined an award of 100 credits for the BAR-BAR-WILD winning symbol combination (which is considered to be the BAR-BAR-BAR winning symbol combination by virtue of the WILD symbol portion) formed by BAR symbol 224*c*, BAR symbol 224*d*, and WILD symbol portion 224*e* displayed from left to right along payline A; an award of 100 credits for the BAR-BAR-WILD winning symbol combination (which is considered to be the BAR-BAR-WILD winning symbol combination by virtue of the WILD symbol portion) formed by BAR symbol 224*c*, BAR symbol 224*d*, and WILD symbol portion 324*e* displayed from left to right along payline A; and an award of 100 credits for the BAR-BAR-WILD winning symbol combination formed by BAR symbol 224*c*, BAR symbol 224*d*, and WILD symbol portion 424*e* displayed from left to right along payline A. Award indicator 218 displays the total award of 300 credits, and the player's credit balance indicated by credit meter 214 is updated to reflect the player's 300 credit award such that the player's total credit balance is 39,650 credits.

Although the above-described embodiments and examples describe the gaming system and method displaying one or more additional symbols of a symbol stack when less than all of the symbols of the symbol stack are displayed with respect to a primary wagering game, it should be appreciated that the present disclosure contemplates doing so with respect to a bonus or secondary game.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to below as an "EGM." Additionally, for brevity and clarity, unless specifically stated otherwise, "EGM" as used below represents one EGM or a plurality of EGMs, and "central server, central controller, or remote host" as used below represents one central server, central controller, or remote host or a plurality of central servers, central controllers, or remote hosts.

Figure 3A:
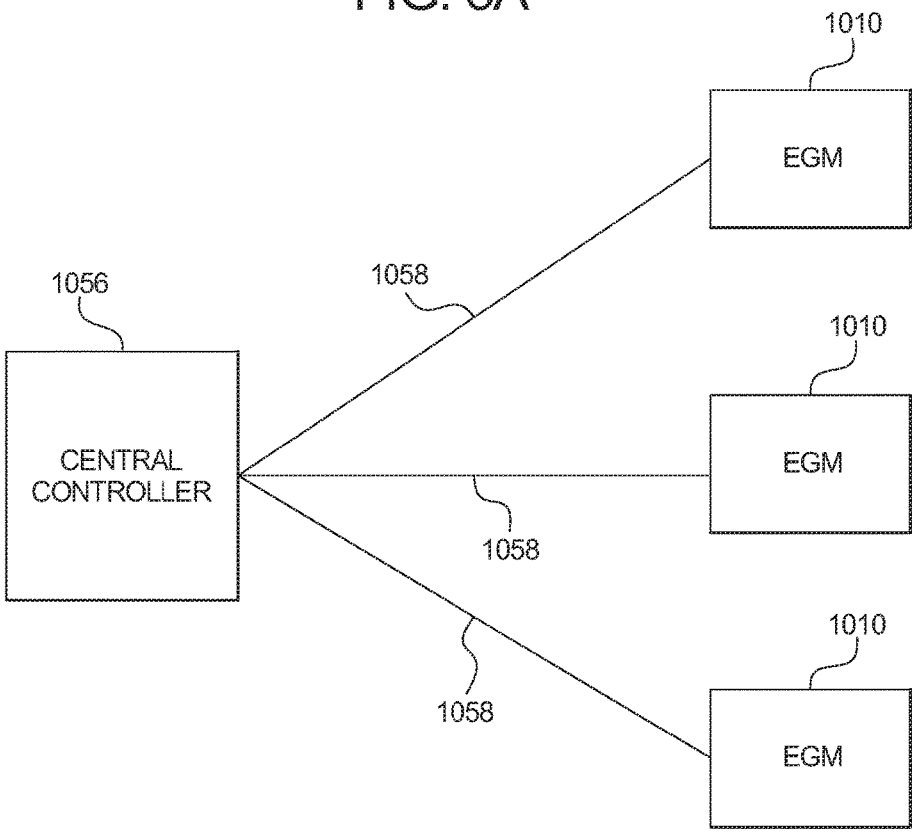
FIG. 3A is a schematic block diagram of one embodiment of the gaming system disclosed herein including a central server, central controller, or remote host configured to communicate with a plurality of EGMs over a data network or remote communications link.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
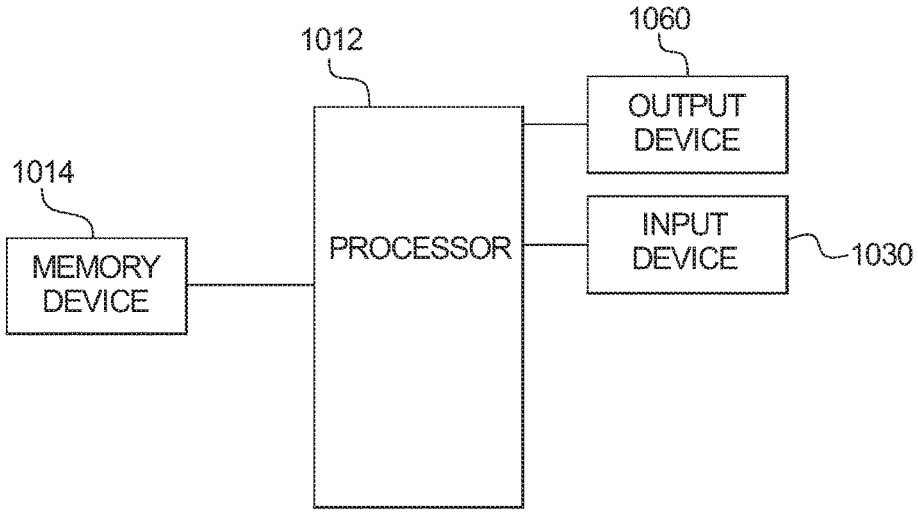
FIG. 3B is a schematic block diagram of an example electronic configuration of an EGM of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
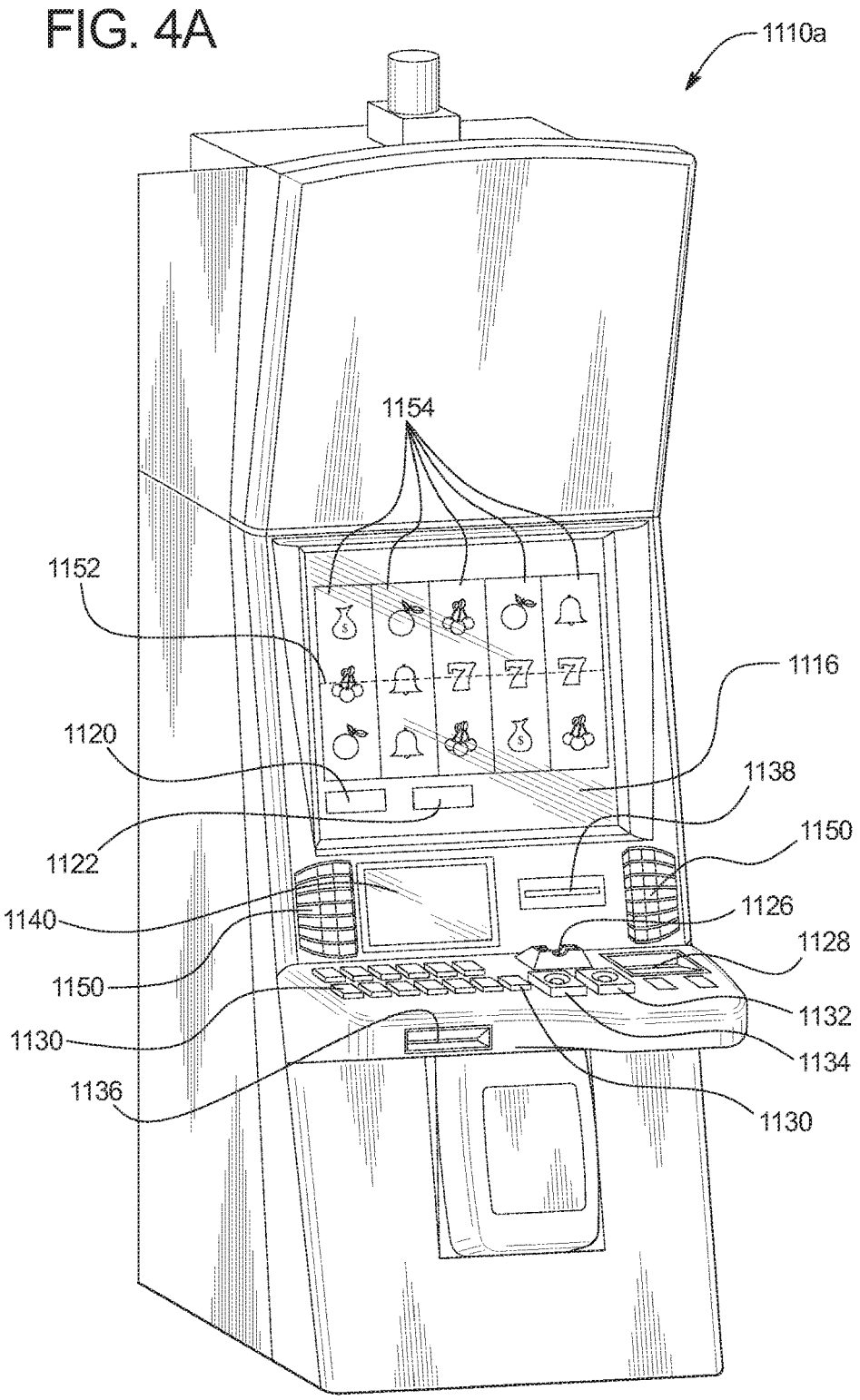
FIGS. 4A and 4B are perspective views of example alternative embodiments of EGMs of the present disclosure.
Figure 4B:
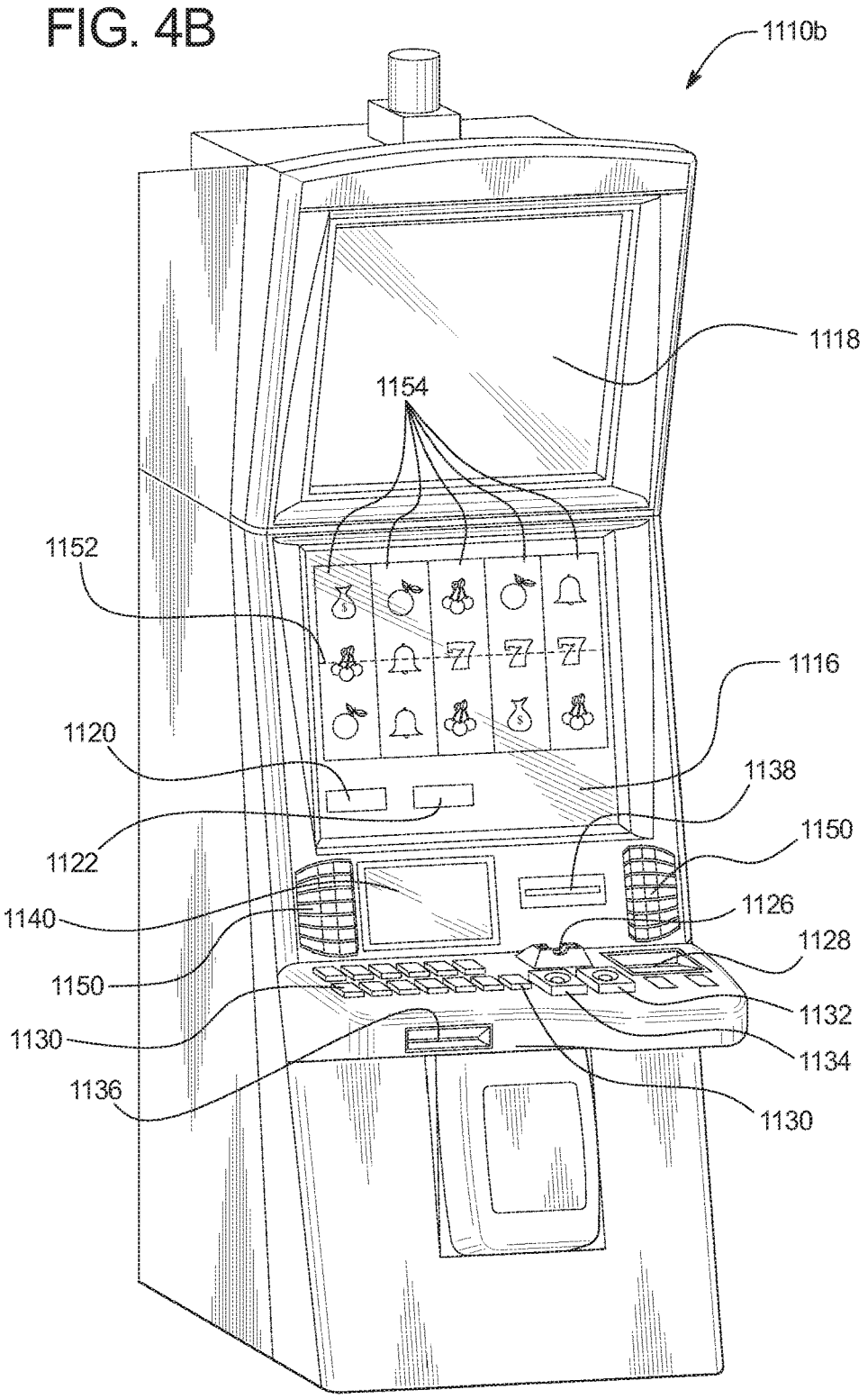

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 4A and 4B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A dedicated thick client electronic gaming machine comprising:

at least one display device;

a plurality of input devices including a payment acceptor;

at least one processor; and at least one memory device that stores a plurality of instructions prior to any plays of any games provided by the dedicated thick client electronic gaming machine, wherein when executed by the at least one processor, the plurality of instructions cause the at least one processor to:

responsive to receipt, by the payment acceptor, of a physical item associated with a monetary value, establish a credit balance based on the monetary value associated with the physical item and cause the at least one display device to display the credit balance, wherein the physical item is selected from the group consisting of: a ticket associated with the monetary value and a unit of currency;

cause the at least one display device to display a plurality of reels in association with a plurality of equally-sized symbol display areas, each reel including a plurality of symbols, the plurality of symbols of a first one of the plurality of reels including a plurality of designated symbols arranged adjacent to one another;

for each reel, randomly determine a plurality of the plurality of symbols on that reel and cause the at least one display device to display the plurality of the plurality of symbols at the equally-sized symbol display areas associated with that reel;

in response to the display of at least a first quantity of the plurality of adjacently arranged designated symbols of the first reel but less than a second greater quantity of the plurality of adjacently arranged designated symbols of the first reel at the equally-sized symbol display areas associated with the first reel, cause the at least one display device to display at least one initially non-displayed designated symbol of the plurality of adjacently arranged designated symbols of the first reel at one of the equally-sized symbol display areas at which one of the plurality of adjacently arranged designated symbols of the first reel is already displayed, wherein the display is in addition to any already-displayed designated symbols of the plurality of adjacently arranged designated symbols of the first reel such that the second quantity of the plurality of adjacently arranged designated symbols of the first reel are displayed at the one of the equally-sized symbol display areas;

after any additional designated symbols of the plurality of adjacently arranged designated symbols of the first reel are displayed, determine any awards based on the displayed symbols and cause the at least one display device to display any determined awards, the credit balance being increasable by any determined awards; and responsive to a cashout input, initiate a payout associated with the credit balance.

2. The dedicated thick client electronic gaming machine of claim 1, wherein a total quantity of the plurality of adjacently arranged designated symbols is equal to a total quantity of the equally-sized symbol display areas associated with the first reel.

3. The dedicated thick client electronic gaming machine of claim 1, wherein the first quantity of the plurality of adjacently arranged designated symbols is one and the second quantity of the plurality of adjacently arranged designated symbols is three.

4. The dedicated thick client electronic gaming machine of claim 1, wherein a second one of the plurality of reels includes multiple designated symbols arranged adjacent to one another, and wherein the plurality of instructions, when executed by the at least one processor, cause the at least one processor to in response to the display of at least a third quantity of the multiple adjacently arranged designated symbols of the second reel but less than a fourth quantity of the multiple adjacently arranged designated symbols of the second reel at the equally-sized symbol display areas associated with the second reel, cause the at least one display device to display at least one initially non-displayed designated symbol of the multiple adjacently arranged designated symbols of the second reel in addition to any already-displayed designated symbols of the multiple adjacently arranged designated symbols of the second reel such that the fourth quantity of the multiple adjacently arranged designated symbols of the second reel is displayed.

5. The dedicated thick client electronic gaming machine of claim 4, wherein the first and third quantities are the same and wherein the second and fourth quantities are the same.

6. The dedicated thick client electronic gaming machine of claim 1, wherein at least two of the plurality of reels include different pluralities of symbols.

7. A method of operating a dedicated thick client electronic gaming machine, the method comprising:

responsive to receipt, by a payment acceptor, of a physical item associated with a monetary value, establishing, by at least one processor, a credit balance based on the monetary value associated with the physical item, wherein the physical item is selected from the group consisting of: a ticket associated with the monetary value and a unit of currency;

causing, by the at least one processor, at least one display device to display the credit balance;

causing, by the at least one processor, the at least one display device to display a plurality of reels in association with a plurality of equally-sized symbol display areas, each reel including a plurality of symbols, the plurality of symbols of a first one of the reels including a plurality of designated symbols arranged adjacent to one another;

for each reel, randomly determining, by at least one processor, a plurality of the plurality of symbols on that reel and causing, by the at least one processor, the at least one display device to display the plurality of the plurality of symbols at the equally-sized symbol display areas associated with that reel;

in response to the display of at least a first quantity of the plurality of adjacently arranged designated symbols of the first reel but less than a second greater quantity of the plurality of adjacently arranged designated symbols of the first reel at the equally-sized symbol display areas associated with the first reel, causing, by the at least one processor, the at least one display device to display at least one initially non-displayed designated symbol of the plurality of adjacently arranged designated symbols of the first reel at one of the equally-sized symbol display areas at which one of the plurality of adjacently arranged designated symbols of the first reel is already displayed, wherein the display is in addition to any already-displayed designated symbols of the plurality of adjacently arranged designated symbols of the first reel such that the second quantity of the plurality of adjacently arranged designated symbols of the first reel are displayed at the one of the equally-sized symbol display areas;

after any additional designated symbols of the plurality of adjacently arranged designated symbols of the first reel are displayed, determining, by the at least one processor, any awards based on the displayed symbols and causing, by the at least one processor, the at least one display device to display any determined awards, the credit balance being increasable by any determined awards; and responsive to a cashout input, initiating, by the at least one processor, a payout associated with the credit balance.

8. The method of claim 7, wherein a total quantity of the plurality of adjacently arranged designated symbols is equal to a total quantity of the equally-sized symbol display areas associated with the first reel.

9. The method of claim 7, wherein the first quantity of the plurality of adjacently arranged designated symbols is one and the second quantity of the plurality of adjacently arranged designated symbols is three.

10. The method of claim 7, wherein a second one of the plurality of reels includes multiple designated symbols arranged adjacent to one another, and which includes:

in response to the display of at least a third quantity of the multiple adjacently arranged designated symbols of the second reel but less than a fourth quantity of the multiple adjacently arranged designated symbols of the second reel at the equally-sized symbol display areas associated with the second reel, causing, by the at least one processor, the at least one display device to display at least one initially non-displayed designated symbol of the multiple adjacently arranged designated symbols of the second reel in addition to any already-displayed designated symbols of the multiple adjacently arranged designated symbols of the second reel such that the fourth quantity of the multiple adjacently arranged designated symbols of the second reel is displayed.

11. The method of claim 10, wherein the first and third quantities are the same and wherein the second and fourth quantities are the same.

12. The method of claim 7, which is at least partially provided through a data network.

13. The method of claim 12, wherein the data network is an internet.

14. The method of claim 7, wherein at least two of the plurality of reels include different pluralities of symbols.

15. A gaming system comprising:

a processor; and a memory device that stores a plurality of instructions that, when executed by the processor, cause the processor to:

communicate data which results in a display device of a thin-client gaming device displaying a plurality of reels in association with a plurality of equally-sized symbol display areas, each reel including a plurality of symbols, the plurality of symbols of a first one of the plurality of reels including a plurality of designated symbols arranged adjacent to one another;

for each reel:

randomly determine a plurality of the plurality of symbols on that reel, and communicate data which results in the display device of the thin-client gaming device displaying the plurality of the plurality of symbols at the equally-sized symbol display areas associated with that reel;

in response to the display of at least a first quantity of the plurality of adjacently arranged designated symbols of the first reel but less than a second greater quantity of the plurality of adjacently arranged designated symbols of the first reel at the symbol display areas associated with the first reel, communicate data which results in the display device of the thin-client gaming device displaying at least one initially non-displayed designated symbol of the plurality of adjacently arranged designated symbols of the first reel at one of the equally-sized symbol display areas at which one of the plurality of adjacently arranged designated symbols of the first reel is already displayed, wherein the display is in addition to any already-displayed designated symbols of the plurality of adjacently arranged designated symbols of the first reel such that the second quantity of the plurality of adjacently arranged designated symbols of the first reel are displayed at the one of the equally-sized symbol display areas;

after any additional designated symbols of the plurality of adjacently arranged designated symbols of the first reel are displayed:

determine any awards based on the displayed symbols, and communicate data which results in the display device of the thin-client gaming device displaying any determined awards.

16. The gaming system of claim 15, wherein a total quantity of the plurality of adjacently arranged designated symbols is equal to a total quantity of the equally-sized symbol display areas associated with the first reel.

17. The gaming system of claim 15, wherein the first quantity of the plurality of adjacently arranged designated symbols is one and the second quantity of the plurality of adjacently arranged designated symbols is three.

18. The gaming system of claim 15, wherein a second one of the plurality of reels includes multiple designated symbols arranged adjacent to one another, and wherein the plurality of instructions, when executed by the processor in response to the display of at least a third quantity of the multiple adjacently arranged designated symbols of the second reel but less than a fourth quantity of the multiple adjacently arranged designated symbols of the second reel at the symbol display areas associated with the second reel, cause the processor to communicate data which results in the display device of the thin-client gaming device displaying at least one initially non-displayed designated symbol of the multiple adjacently arranged designated symbols of the second reel in addition to any already-displayed designated symbols of the multiple adjacently arranged designated symbols of the second reel such that the fourth quantity of the multiple adjacently arranged designated symbols of the second reel is displayed.

19. The gaming system of claim 18, wherein the first and third quantities are the same and wherein the second and fourth quantities are the same.

20. The gaming system of claim 15, wherein at least two of the plurality of reels include different pluralities of symbols.

* * * * *